US011015427B2

(12) United States Patent
Izuhara et al.

(10) Patent No.: US 11,015,427 B2
(45) Date of Patent: May 25, 2021

(54) SYSTEM AND METHOD FOR QUANTITATIVE CEMENT BOND EVALUATION

(71) Applicant: Schlumberger Technology Corporation, Sugar Land, TX (US)

(72) Inventors: Wataru Izuhara, Tokyo (JP); Naoki Sakiyama, Tokyo (JP); Hiroaki Yamamoto, Kanagawa-Ken (JP); Shin'ichi Watanabe, Kanagawa-ken (JP)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 96 days.

(21) Appl. No.: 15/425,379

(22) Filed: Feb. 6, 2017

(65) Prior Publication Data

US 2017/0226844 A1 Aug. 10, 2017

Related U.S. Application Data

(60) Provisional application No. 62/292,353, filed on Feb. 7, 2016.

(51) Int. Cl.
*E21B 47/00* (2012.01)
*E21B 47/005* (2012.01)

(52) U.S. Cl.
CPC ..... *E21B 47/005* (2020.05)

(58) Field of Classification Search
CPC ..... E21B 47/0005
See application file for complete search history.

(56) References Cited

U.S. PATENT DOCUMENTS 4,703,427 A * 10/1987 Catala ..... G01V 1/50 181/105
4,951,266 A * 8/1990 Hsu ..... G01V 1/48 367/25
5,216,638 A * 6/1993 Wright ..... E21B 47/0005 367/30
5,763,773 A * 6/1998 Birchak ..... E21B 47/0005 73/152.58

(Continued)

FOREIGN PATENT DOCUMENTS

WO WO-2015126243 A1 * 8/2015 ..... E21B 47/0005

OTHER PUBLICATIONS

Kinoshita et al., "Attenuatkm~Based Quantitative Cement Bond Index with LWD Sonic: A Novel Approach Applicable to all Casing and Cement Cases", Oct. 2014, pp. 1-18.*

(Continued)

*Primary Examiner* — Mohamed Charioui
*Assistant Examiner* — Eyob Hagos

(57) ABSTRACT

A technique facilitates cement bonding evaluation including collecting waveform data and pre-processing the waveform data. The technique also may utilize processes which provide a time window position for the pre-processed waveform data and calculation of waveform amplitude and/or attenuation. Additionally, the technique may include deriving an amplitude-based bond index and/or attenuation-based bond index through the use of a model or other suitable waveform data processing technique which enables preparation of quality control plots with respect to the processing results.

18 Claims, 24 Drawing Sheets

$$Amp = A_{col} + A_{cas}$$

$Amp$ : Amplitude at a Receiver
$A_{col}$ : Amplitude of Collar Arrival at a Receiver
$A_{cas}$ : Amplitude of Casing Arrival at a Receiver

(56) References Cited

U.S. PATENT DOCUMENTS

| | | | | |
|---|---|---|---|---|
| 2003/0156494 | A1* | 8/2003 | McDaniel | G01V 1/44 367/35 |
| 2006/0039238 | A1* | 2/2006 | Mandal | G01V 1/48 367/31 |
| 2007/0127311 | A1* | 6/2007 | Garcia-Osuna | G01V 13/00 367/13 |
| 2011/0149684 | A1* | 6/2011 | Hurst | G01V 1/46 367/34 |
| 2015/0168581 | A1 | 6/2015 | Izuhara et al. | |
| 2015/0369939 | A1 | 12/2015 | Pistre et al. | |

OTHER PUBLICATIONS

Kinoshita et al., "Attenuatkm~Based Quantitative Cement Bond Index with LWD Sonic: A Novel Approach Applicable to all Casing and Cement Cases", 2015, pp. 1-18.*

Pistre et al., "Attenuation-based Quantitative Cement Bond Index with LWD Sonic: A Novel Approach Applicable to all Casing and Cement Cases" SPE 170886, SPE Annual Technical Conference and Exhibition, Amsterdam, The Netherlands, Oct. 27-29, 2014. 18 pages.

* cited by examiner $$Amp = A_{col} + A_{cas}$$

$Amp$ : Amplitude at a Receiver
$A_{col}$ : Amplitude of Collar Arrival at a Receiver
$A_{cas}$ : Amplitude of Casing Arrival at a Receiver

SYSTEM AND METHOD FOR QUANTITATIVE CEMENT BOND EVALUATION

CROSS-REFERENCE TO RELATED APPLICATION

This application claims the benefit of and priority to U.S. Provisional Application Ser. No. 62/292,353, filed Feb. 7, 2016, which is incorporated herein by reference in its entirety.

BACKGROUND

Hydrocarbon fluids such as oil and natural gas are obtained from a subterranean geologic formation, referred to as a reservoir, by drilling a well that penetrates the hydrocarbon-bearing formation. In many wells, casing is used to line the wellbore and to ensure the integrity of the well. The casing is cemented in place to secure the casing and to prevent gas or other fluids from flowing in the annulus created between the casing and the wellbore. If the cement is not sufficiently bonded to the casing, fluid leakage can occur and can sometimes lead to various types of problems. In the past, evaluation of the cement bonding to the casing has sometimes been insufficient to ensure safe wellsite operations and to prevent unwanted conveyance of potentially dangerous gases.

SUMMARY

In general, a methodology and system are described for facilitating cement bonding evaluation, and the technique may include collecting waveform data and pre-processing the waveform data. In some embodiments, the technique also may utilize processes which provide a time window position for the pre-processed waveform data and calculation of waveform amplitude and/or attenuation. The technique also may include deriving an amplitude-based bond index and/or attenuation-based bond index through the use of a model or other suitable waveform data processing technique which enables preparation of quality control plots with respect to the processing results.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and:

FIGS. 19A and 19B are graphical illustrations showing examples of two plots of bond indices from apparent attenuation in which FIG. 19A represents lower bonding for a quality control purpose and FIG. 19B represents a higher bonding in conjunction with a hybrid log, according to an embodiment of the disclosure;

DETAILED DESCRIPTION

Figure 1A:
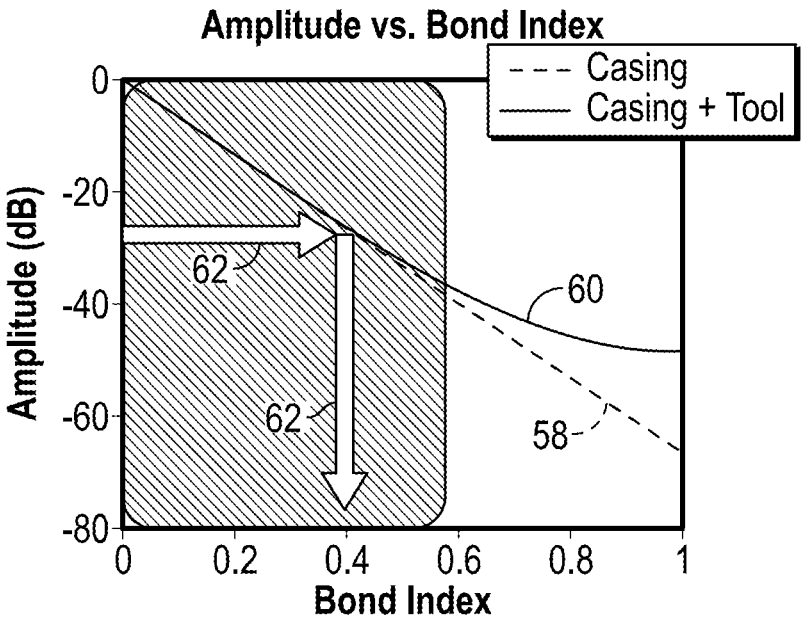
FIGS. 1A and 1B are a graphical illustration showing two plots, FIG. 1A providing an example of amplitude versus bond index and FIG. 1B showing an example of attenuation versus bond index, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

Embodiments described herein facilitate cement bonding evaluation, and the techniques may include collecting waveform data and pre-processing the waveform data. In some embodiments, the technique also may utilize processes which provide a time window position for the pre-processed waveform data. The technique also may include calculation of waveform amplitude, waveform attenuation, or in some cases a hybrid combination of waveform amplitude and attenuation. The technique also may include deriving an amplitude-based bond index and/or attenuation-based bond index through the use of a waveform data processing technique, e.g. model, which enables preparation of quality control plots with respect to the processing results. The data processing may be conducted via various processing tools such as a computer-based system having one or more computers in which the acoustic waveform data is processed and then the results regarding cement bond quality are output to an appropriate output device, e.g. computer display.

As used herein, the term "downhole" refers to a subterranean environment, e.g. an environment in a wellbore. Accordingly, "downhole tool" is used broadly to mean a tool employed in a subterranean environment. Examples of such tools may include a logging tool, an imaging tool, an acoustic tool, a permanent monitoring tool, combination tools, or other tools for use in the subterranean environment.

The various techniques described herein may be utilized to facilitate and improve data acquisition and analysis in downhole tools and systems. Embodiments described herein may utilize downhole tools and systems which employ arrays of sensing devices configured or designed for easy attachment and detachment in downhole sensor tools. For example, the downhole sensor tools may include modules deployed for sensing data which relates to environmental and/or tool parameters within a borehole. Tools and sensing systems disclosed herein may be used to effectively sense and store characteristics related to components of downhole tools as well as formation parameters, e.g. formation parameters at elevated temperatures and pressures.

Embodiments described herein may have acoustic sensing systems incorporated into tools such as wireline logging tools, measurement-while-drilling tools, logging-while-drilling tools, permanent monitoring systems, drill bits, drill collars, sondes, or other tools. When such tools are referenced herein, it should be noted that such tools may be deployed via various mechanisms, including drill string, wireline, cable line, slick line, coiled tubing, or other suitable conveyance mechanisms.

As described in greater detail below, various embodiments utilize improved techniques for quantitative cement bond evaluation. Embodiments may include bond index logs using waveform amplitude and/or attenuation. For example, a methodology may utilize an attenuation-based approach with a model for summation of casing and collar arrivals to overcome certain limitations of an amplitude-based method in high bonding conditions. The decreasing relationship of apparent attenuation with increasing bond index at high bonding conditions is useful for successfully employing certain embodiments of the methodology. The relationship may be used to convert apparent attenuation to a bond index in an attenuation-based method. On the other hand, the relationship can vary depending on the method of processing data, e.g. a decreasing trend may not be seen in some conditions if the processing workflow is not appropriately constructed. As described below, proper workflow can be helpful in achieving success when the methodologies described herein are applied in a wide range of conditions.

Embodiments described herein provide a processing workflow for methods of cement bond evaluation. Such embodiments of the workflow enable full-range bond index (BI) evaluation for a wide range of logging conditions. Additionally, embodiments described herein may include various methods for quality control to ensure reliability of processing results. These embodiments may further enable rerunning of the processing with proper parameter settings.

Figure 1B:
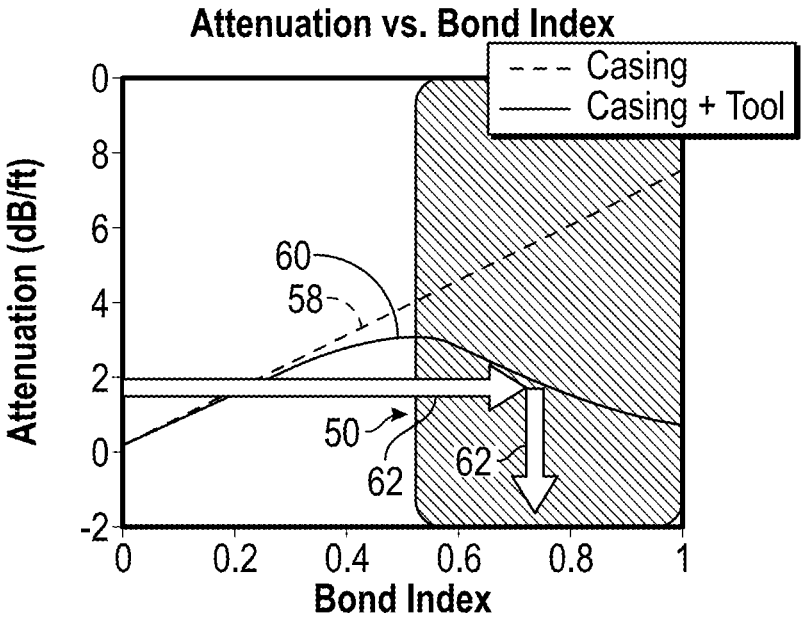

As illustrated by FIGS. 1A and 1B, in some bond index logs using amplitude and attenuation of sonic waveforms a logarithmic scale of measured peak-to-peak amplitude may be linearly converted to a bond index for a lower bonding condition, e.g. a lower quality level of bonding between cement and well casing. Such methodology may be referred to as an amplitude-based method and is indicated by FIG. 1A. When a sonic tool is deployed downhole in a casing lining a borehole, a tool transmitter excites an acoustic signal (generally below 30 kHz) which reaches the casing via adjacent drilling mud. Consequently, a casing extensional mode is generated. The casing extensional mode propagates through the casing while its energy is leaked to the outside cement if cement is present and then back to a receiver via the mud.

By looking at the amplitude of the casing mode detected at a receiver, e.g. an acoustic signal receiver, the quality of cement presence behind the casing, e.g. outside the casing, can be evaluated. Generally, a signal with a high amplitude indicates lower level bonding (poor quality bonding) of the cement with the casing and a signal with a low amplitude indicates higher level bonding (good quality bonding) of the cement with the casing. A bond index (BI) is a normalized ratio of casing circumference bonded by cement such that BI=0 indicates free pipe/casing and BI=1 indicates full bonding of cement with the pipe/casing. The bond index may be derived from the amplitude of the casing mode by using a linear relationship with logarithmic scale of the amplitude in decibel units (dB) as indicated by FIG. 1A and this may be used as one of the indices for quality of the cement bond.

On the other hand, this method may have certain limitations for measuring high bonding levels due to the propagation of acoustic waves on relatively rigid and stiff tools, e.g. stiff logging-while-drilling tools. Such tools may have almost the same propagation speed as the casing mode and may thus contaminate the casing signal. An example describing use of acoustic wave amplitudes may be found in US Patent Publication No. 2015/0168581 (Wataru IZU- HARA et al.), published 18 Jun. 2015, the contents of which are incorporated herein by reference.

For high bonding conditions, apparent attenuation may be calculated based on amplitudes detected through receiver arrays and then converted to a bond index and this approach may be referred to as an attenuation-based methodology. With logging-while-drilling tools, the trend of attenuation with increasing bond index is unique due to the presence of propagation of acoustic waves on the tool. The attenuation provides a bell-shaped trend such that attenuation increases first in lower bonding conditions and then decreases in higher bonding conditions with increasing bond index.

Figure 2:
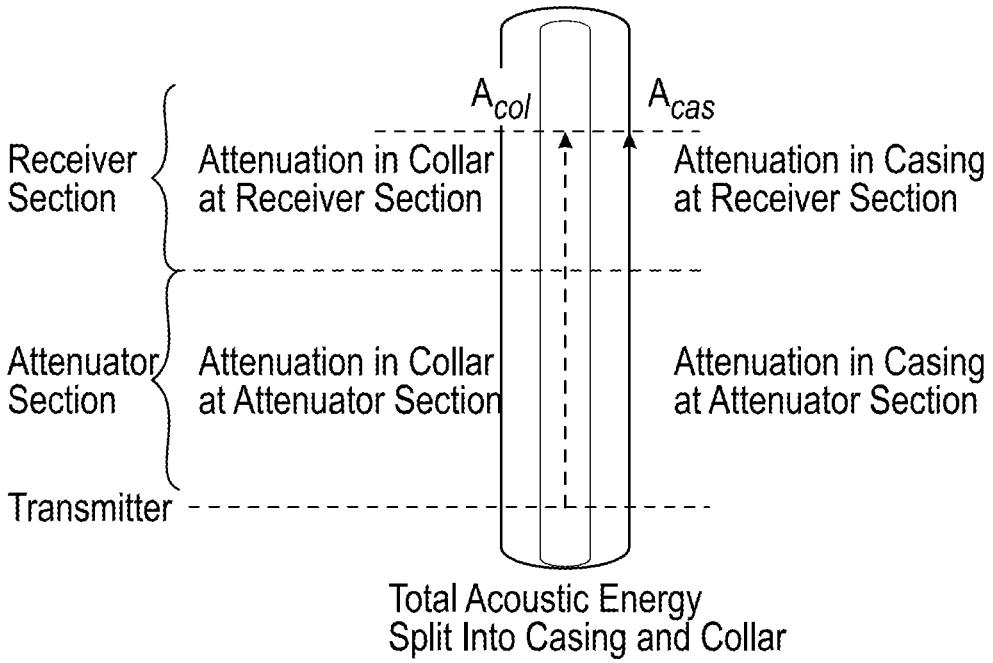
FIG. 2 is a diagram showing a cross-sectional representation of a well and a corresponding example of a summation model for casing and tool collar arrivals, according to an embodiment of the disclosure.
Figure 3:
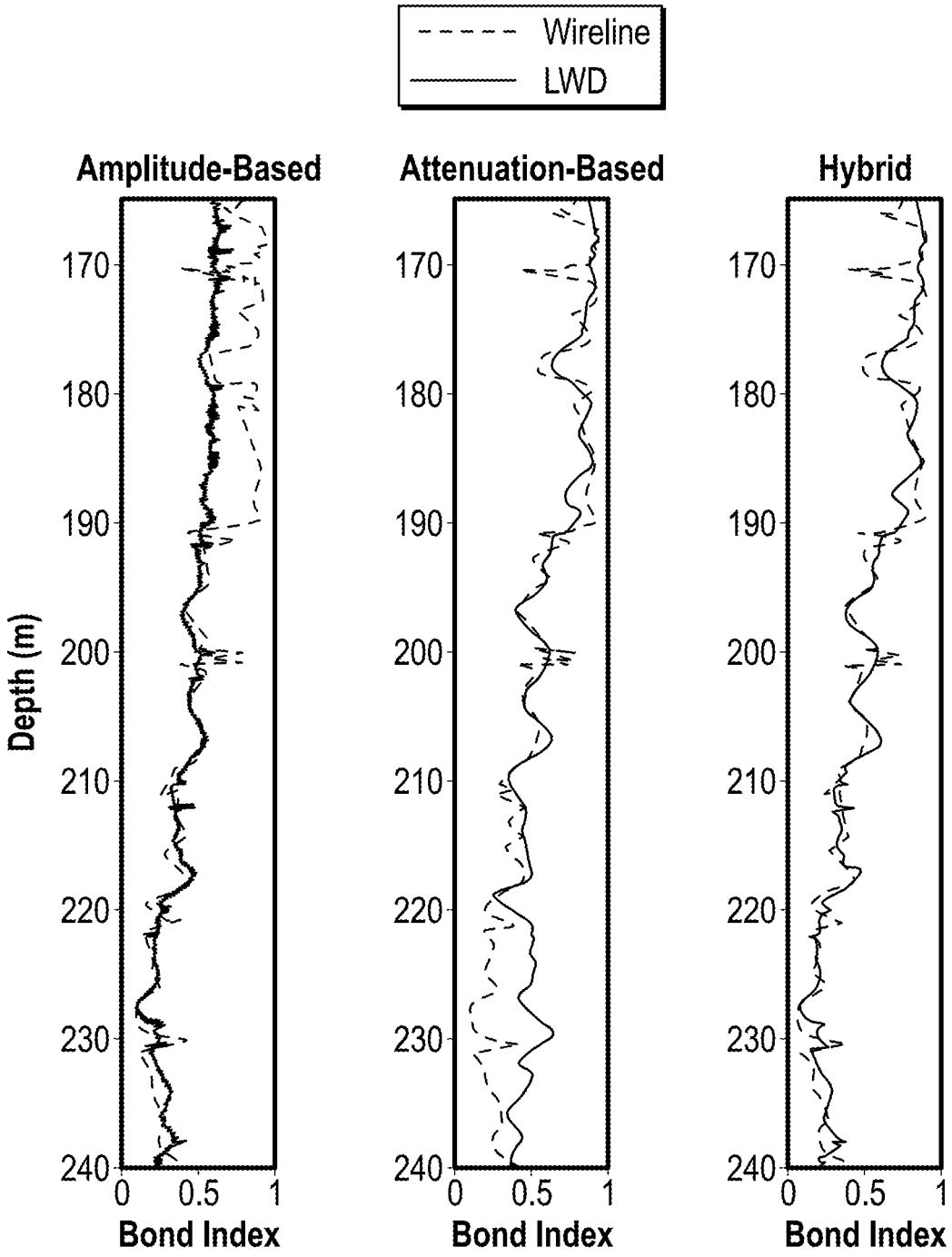
FIG. 3 is a graphical illustration showing three plots of bond indices versus depth using amplitude-based, attenuation-based, and hybrid methodologies, according to an embodiment of the disclosure.

According to an embodiment, the decreasing relationship of the attenuation with the increasing bond index was used to evaluate high bonding level conditions, as indicated by FIG. 1B. The decreasing relationship may be derived from a summation model of casing signal arrivals and tool signal arrivals, as shown in FIG. 2, with proper model parameters. This model assumes amplitudes of casing and tool signal arrivals based on several parameters, including attenuation rates of the two acoustic signal arrivals and the sum of the two arrivals as the signal amplitudes are detected at receivers. (FIG. 2 illustrates an example of a tubing, e.g. collar, disposed within a well casing lining a borehole.) After obtaining two bond index logs, e.g. a low bonding index log via an amplitude-based approach and a high bonding index log via an attenuation-based approached, the two bond index logs are combined as illustrated in FIG. 3, e.g. the two logs may be switched at the 0.4 bond index.

The decreasing relationship of apparent attenuation at high bonding conditions (see region 50 in FIG. 1B) may be used to convert the apparent attenuation to a bond index in an attenuation-based method. On the other hand, the decreasing relationship can vary depending on the method of processing data, and a relatively smooth trend may not be seen if a suitable processing method is not applied. With additional reference to FIGS. 4A and 4B, an example is provided in which an 11.75 inch casing is used.

Figure 4A:
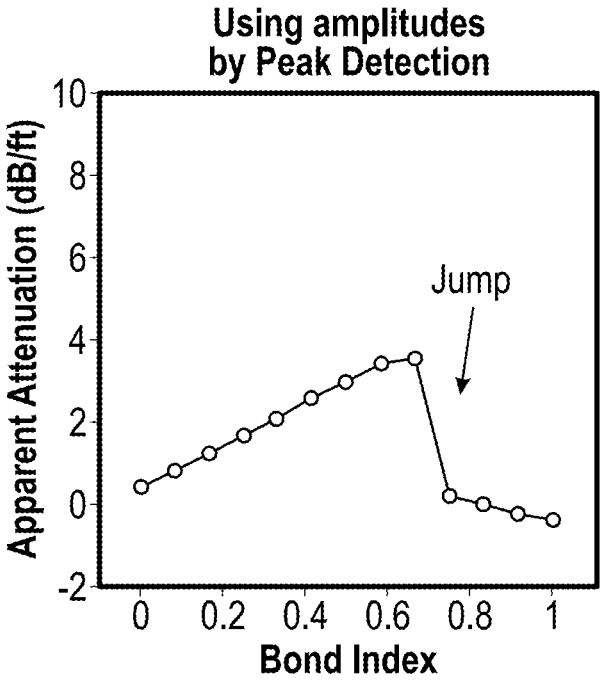
FIGS. 4A and 4B are graphical illustrations showing two plots of apparent attenuation versus bond index using amplitudes by peak detection in FIG. 4A and using an amplitude envelope at a fixed time in FIG. 4B, according to an embodiment of the disclosure.
Figure 4B:
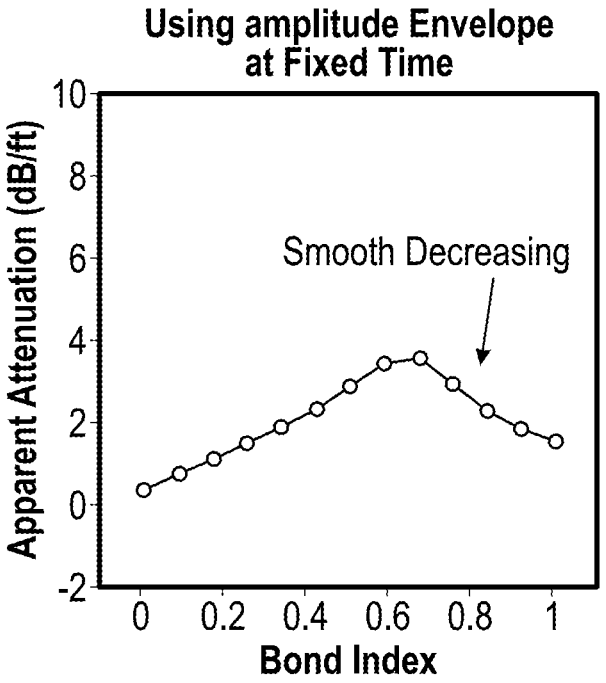

In this example, two different processing methods are employed for early packets of the acoustic signal, e.g. waveform, arriving via casing mode. In the first processing method, attenuation is calculated with peak amplitude detection through acoustic receiver arrays as indicated in FIG. 4A. In the second processing method, attenuation is calculated with amplitudes of envelopes at a fixed-time as indicated in FIG. 4B. According to the first processing method, apparent attenuation jumps at around a 0.7 bond index and becomes rather flat at higher bond index numbers, thus making conversion to a bond index difficult. However, the smooth decreasing relationship obtained by the second processing method enables conversion to a bond index at these higher bond index values. Thus, the more suitable processing method/workflow may be applied for the appropriate conditions.

Figure 5:
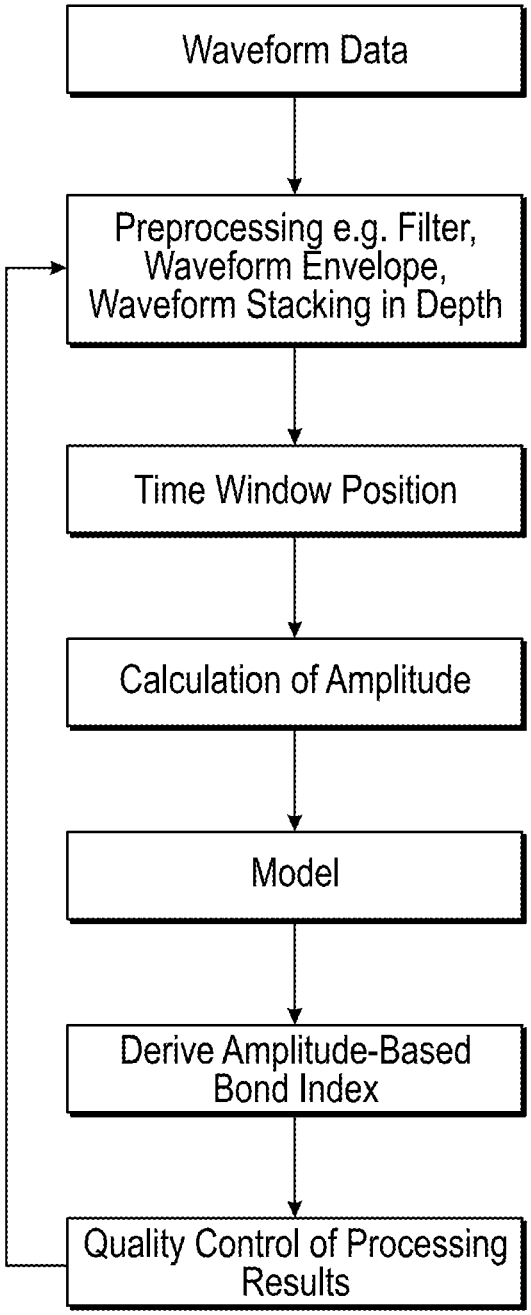
FIG. 5 is an example of a workflow for an amplitude-based method, according to an embodiment of the disclosure.
Figure 6:
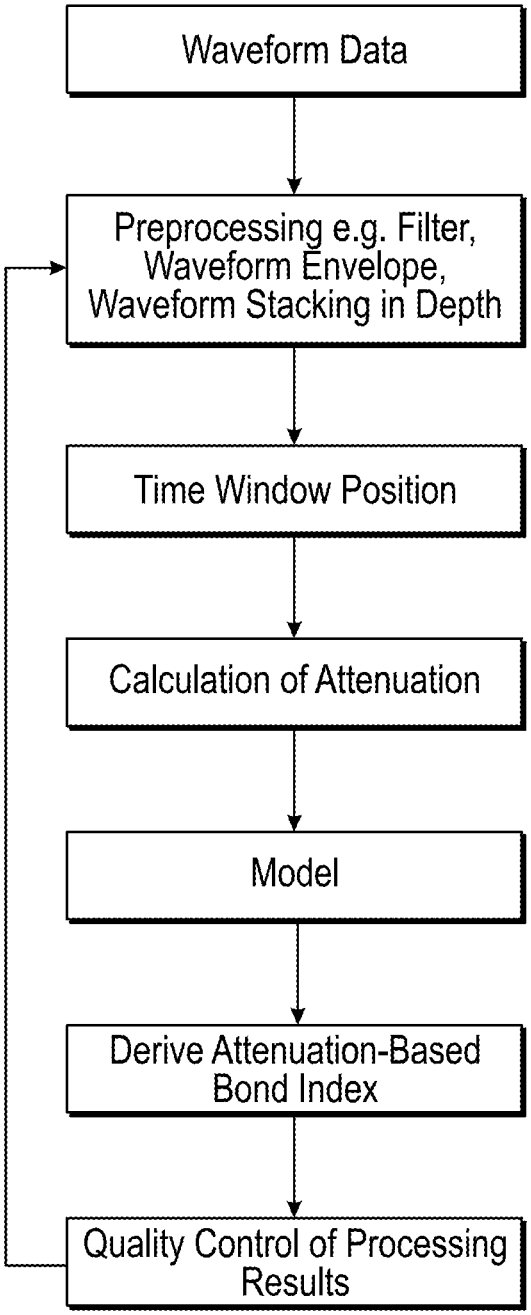
FIG. 6 is an example of a workflow for an attenuation-based method, according to an embodiment of the disclosure.
Figure 7:
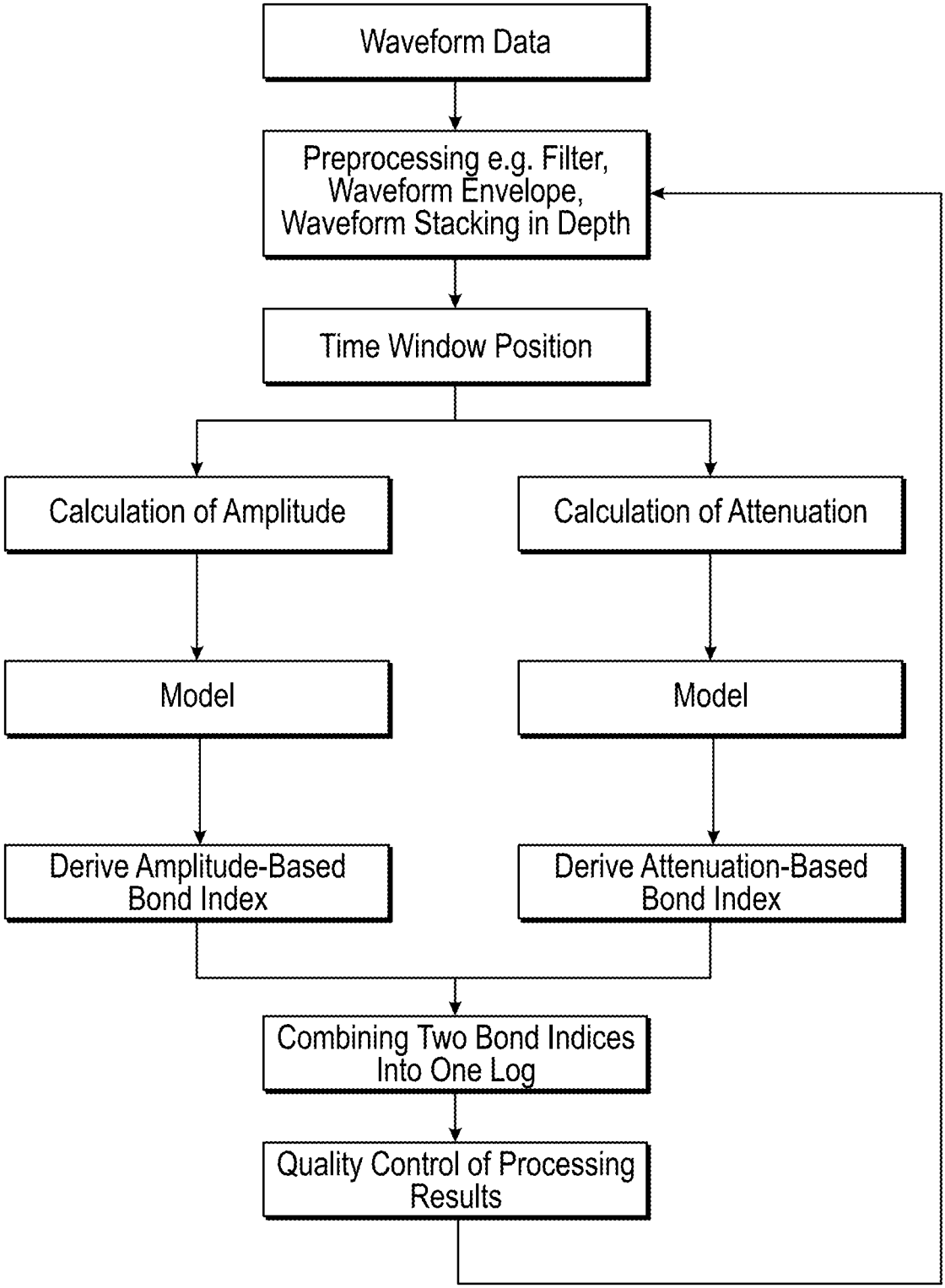
FIG. 7 is an example of a workflow for a hybrid-based method, according to an embodiment of the disclosure.

Embodiments of processing workflows enable methods of cement bond evaluation which may be applied in a wide range of conditions. Examples of such workflows are illustrated in FIGS. 5-7. In FIGS. 5 and 6, for example, an amplitude-based workflow and an attenuation-based workflow methodology are illustrated respectively. As illustrated, acoustic waveform data may be obtained via acoustic receivers and this waveform data may be preprocessed, e.g. preprocessed via filtering, use of a waveform envelope, or waveform stacking in depth. A time window position is then selected to facilitate calculation of amplitude (see FIG. 5) and/or calculation of attenuation (see FIG. 6). The processed data may then be applied to a suitable model to drive an amplitude-based bond index (see FIG. 5) and/or an attenuation-based bond index (see FIG. 6). The results from processing the data may then be subjected to quality control and, if desired, subjected to further preprocessing as described above. The workflow in FIG. 7 illustrates a hybrid method based on both amplitude-based and attenuation-based methods. As indicated, both the amplitude-based bond index and the attenuation-based bond index are derived and then these indices are combined into one bond index log. The individual stages or elements of these various workflows are explained in greater detail below.

Figure 8:
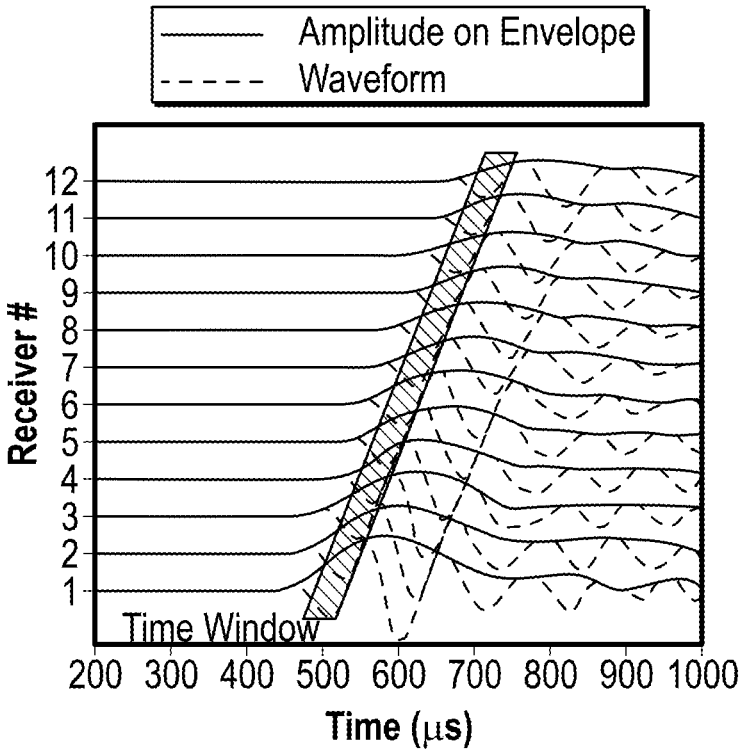
FIG. 8 is a graphical illustration having a plot showing an example of waveform envelopes, according to an embodiment of the disclosure.

In some embodiments, the initial stage of the methodology includes preprocessing acquired acoustic signals, e.g. acquired waveforms. The preprocessing of signals may include application of frequency filters, such as FIR (finite impulse response) and/or IIR (infinite impulse response) frequency filters, to the waveform data followed by calculation of waveform envelopes, as represented in FIG. 8. Waveform stacking in a certain depth range also may be applied to increase the signal-to-noise ratio. According to an example, a waveform envelope of the acquired data can be obtained by employing an absolute amplitude of its analytic signal using a Hilbert transform, an available technique for signal processing.

Figure 9:
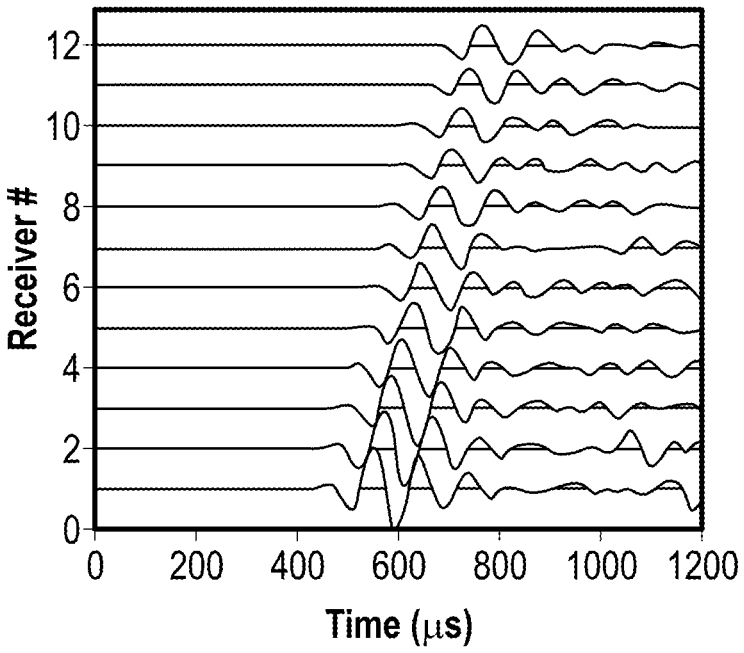
FIG. 9 is a graphical illustration showing an example of a plot having a time window, according to an embodiment of the disclosure.

As illustrated in FIGS. 5-7, another process of the workflow may include setting a time window position where the amplitude is detected and the attenuation is calculated, as represented graphically in FIG. 9. Depending on the application, adjustable time windows may be applied at each depth and/or fixed time windows may be applied at multiple depths. The position of the time window may vary depending on logging conditions such as casing size. Time window selection also may be based on a time derivative plot of apparent attenuation (see, for example, track number 9 in FIGS. 14A-14C and explained in greater detail below). Moveout of the time window through a receiver array (i.e. the time delay moving through more distant axial receivers) also may be another parameter to which the nominal slowness of the casing or tool arrival can be referred.

Figure 10:
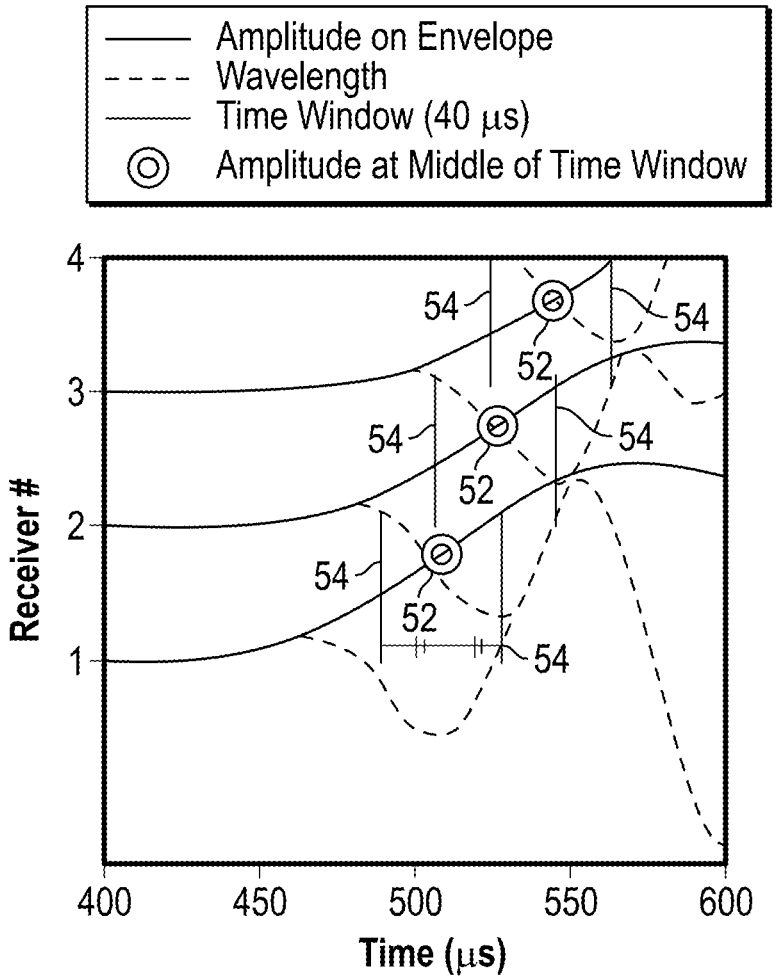
FIG. 10 is a graphical illustration showing an example of a plot providing amplitude detection for an amplitude-based method, according to an embodiment of the disclosure.

Embodiments of the workflow also may include calculation of attributes such as amplitude and apparent attenuation. With the selected time window and preprocessed waveform data, attributes for cement evaluation may be calculated. Examples of such attributes include amplitude and apparent attenuation. For example, the waveform amplitude may be detected as an attribute of the amplitude-based methodology. FIG. 10 illustrates an example for detecting the amplitude in a given envelope (indicated by circles 52) at the middle of the time window (indicated by pairs of lines 54). An amplitude of the signal either in real waveform or on the envelope can be detected. Other positions in a given time window for a given receiver also may be selected for amplitude detection.

Figure 11A:
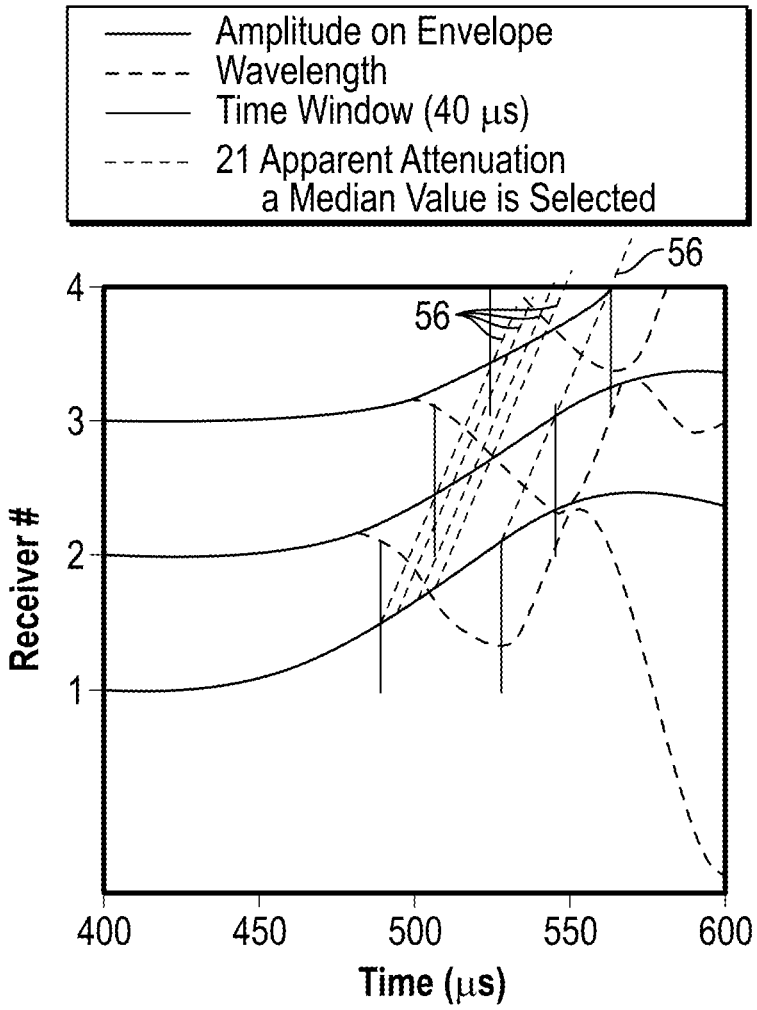
FIGS. 11A and 11B are graphical illustration showing attenuations in a selected time window in FIG. 11A and apparent attenuation based on a linear fitting in FIG. 11B, according to an embodiment of the disclosure.
Figure 11B:
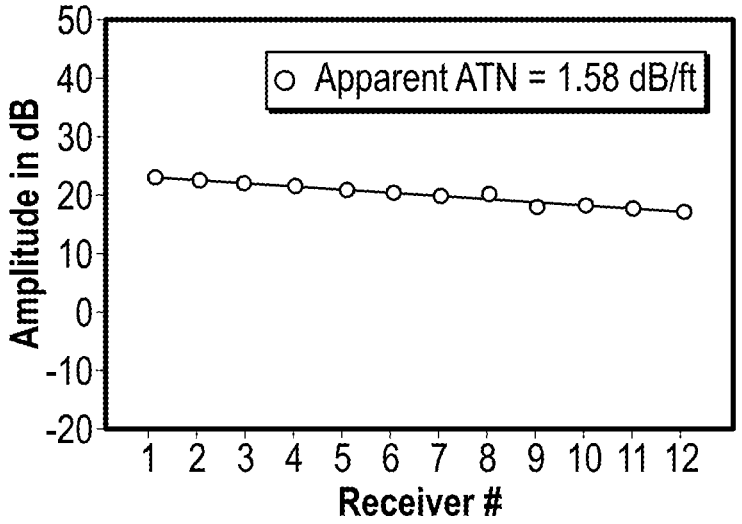

Embodiments of the workflow also may include calculation of attenuation as an attribute of the attenuation-based method. Apparent attenuation may be calculated along a moveout of the selected time window through the receiver array data. An example of median detection of attenuations is illustrated graphically on FIG. 11A. This example uses a 40 μs time window with a 2 μs time sampling rate so that 21 time sample amplitudes per acoustic receiver are obtained. Then, 21 attenuation values may be calculated using the same moveout through receivers, as represented by lines 56. A median of the 21 attenuation values may be considered as the apparent attenuation. Values other than the median also may be applied and may include a geometric/arithmetic mean or simply an attenuation at one position in a time window. The attenuation and each time sample can be calculated using linear fittings of amplitudes over the receiver array, as represented graphically on FIG. 11B. It should be noted the attenuation may be calculated with various combinations of receivers.

The workflow also may include deriving amplitude-based and attenuation-based bond indices. Based on the attributes, e.g. amplitude and apparent attenuation, amplitude-based and/or attenuation-based bond indices may be calculated. For the conversion from amplitude/attenuation to bond indices, a linear model between casing amplitude/attenuation and the bond index may be used (as represented by dashed lines 58 in FIGS. 1A and 1B). Or, a summation model of casing and tool collar arrivals may be used (as represented by solid lines 60 in FIGS. 1A and 1B and considering the model represented in FIG. 2).

In, for example, an application using a logging-while-drilling sonic tool, the summation model may be referred to in high bonding conditions for the attenuation-based methodology due to the presence of the tool arrival (see arrows 62 on FIG. 1B relative to solid line 60). The linear model may be referred to in lower bonding conditions for amplitude-based methodologies (see arrows 62 on FIG. 1B relative to either of the overlapping lines 58 or 60). With additional reference to FIG. 12, a graphical representation is provided which illustrates an example of bond index logs using a logging-while-drilling sonic tool. In this example, the bond indices are calculated using the linear model for an amplitude-based method and the summation model for an attenuation-based method.

Figure 12:
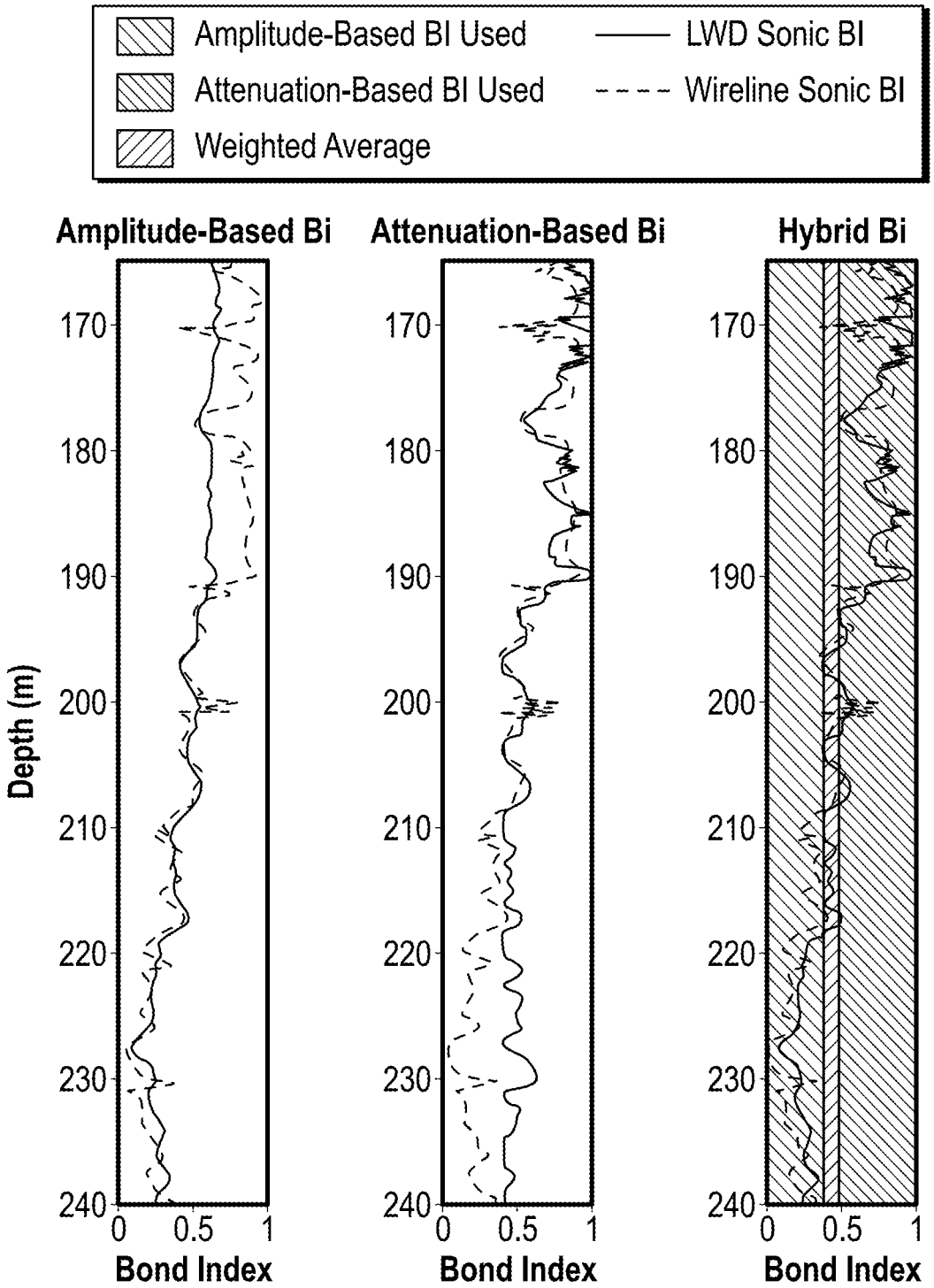
FIG. 12 is a graphical illustration showing three plots indicating an amplitude-based method, an attenuation-based method, and a hybrid method using the combination of amplitude and attenuation methods, according to an embodiment of the disclosure.
Figure 13:
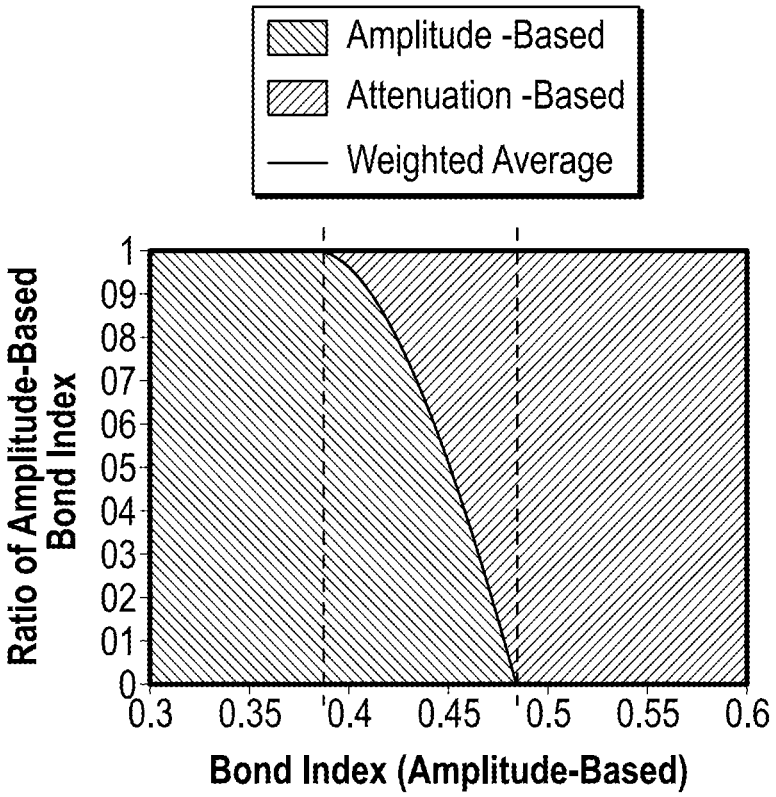
FIG. 13 is a graphical illustration showing a plot having an example of a weight function for a splicing range, according to an embodiment of the disclosure.

With some embodiments, the two bond indices may be combined into one log. Embodiments of the workflow may be used in a hybrid methodology in which two bond index logs, obtained by waveform amplitude-based and waveform attenuation-based methods, are combined into one log for a full-range bond index determination. The right side plot in FIG. 12 illustrates an example of a hybrid log. Continuing with this example, FIG. 12 illustrates a useful amplitude-based approach below a bond index of 0.4 and an attenuation-based approach above a bond index of 0.5 which are then spliced together. Between bond index 0.4 and 0.5, two bond index logs may be averaged with a suitable weighting function, e.g. the smooth weighting function illustrated in FIG. 13. An appropriate splicing range may be determined for the summation model to ensure a relatively smooth transition in splicing the bond index ranges. Additionally, a simple switch between amplitude-based and attenuation-based methods also may be applied.

Embodiments of the workflow also may include processing the results for quality control. With additional reference to FIGS. 14A-14C, a quality control graph having a plurality of quality control plots is illustrated as an example for use in conjunction with a hybrid methodology as described herein. If a single amplitude-based or attenuation-based methodology is applied, some of the plots/tracks illustrated in FIGS. 14A-14C also correspond with outputs from such individual methodologies and may be used for quality control purposes. The series of quality control indicator logs in the illustrated plots enables an operator to ensure reliability of processing results and the appropriateness of the processing parameters. The quality control outputs also may be used to fine-tune processing parameters, such as a time window position based on a time derivative of apparent attenuation (see track #9 in FIG. 14B). Logs corresponding with each track in the quality control plots are numbered along the top of the graph and are explained in greater detail below. The graphical display illustrated in FIGS. 14A-14C also includes an example of a cement bond evaluation output which may be presented via a computer display or other suitable output device.

Figure 14A:
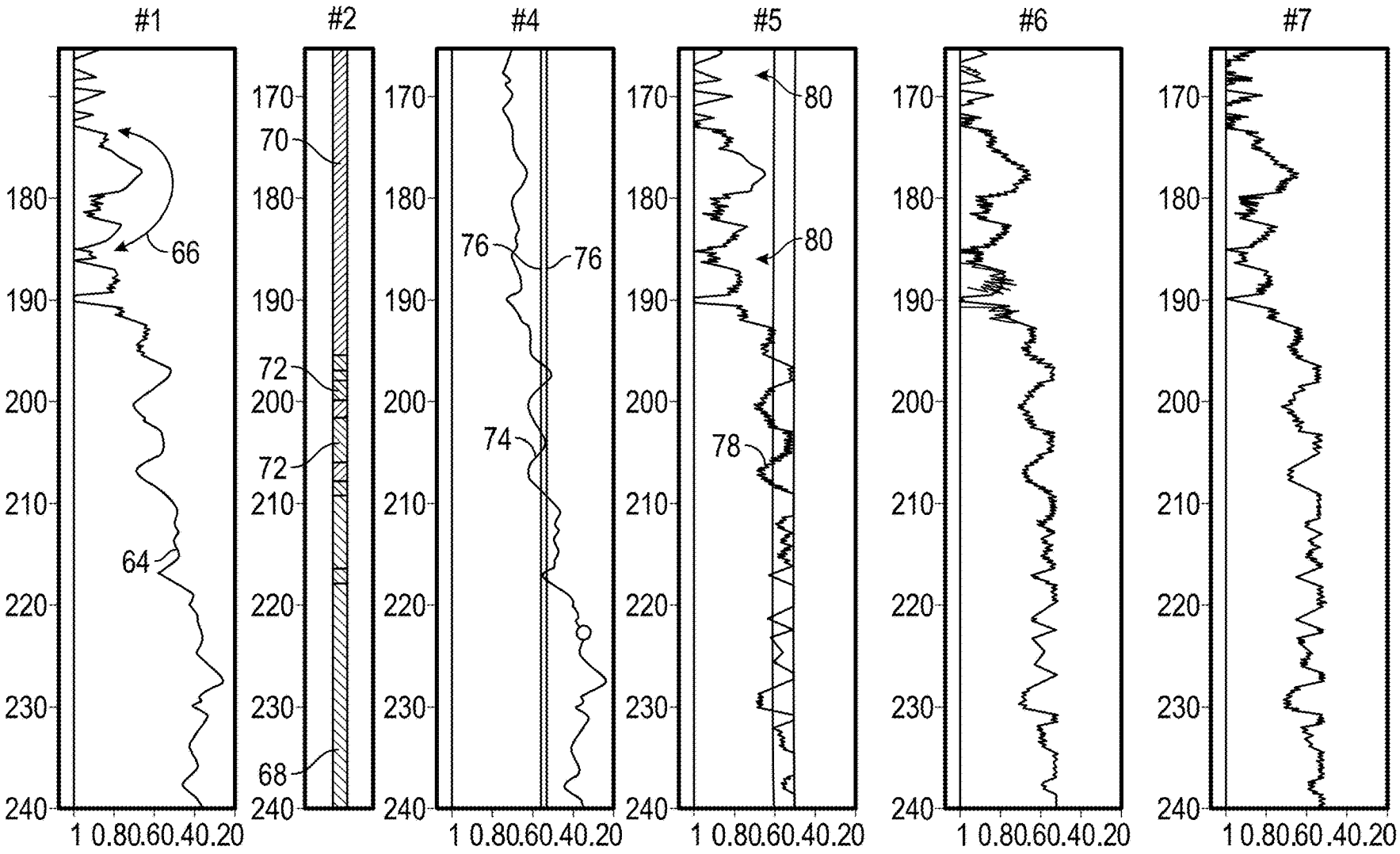
FIGS. 14A-14C are graphical illustrations showing fourteen quality control plots for an example of a hybrid method, according to an embodiment of the disclosure.

With reference to track #1 in FIG. 14A, this track illustrates a bond index log from a hybrid bond index 64. In this example, the hybrid bond index 64 is spliced based on an amplitude bond index and an attenuation bond index using a weight function, such as the weight function illustrated in FIG. 13. A confidence range 66 for the hybrid bond index 64 also is illustrated and provides a quality control method for determining and showing a reliability of the log based on the processing and data quality. The confidence range 66 for the hybrid bond index 64 may be calculated based on amplitude and attenuation confidence ranges. For example, when the amplitude-based methodology is applied, an amplitude confidence range may be used for the hybrid confidence range. When the attenuation-based methodology is applied, an attenuation confidence range may be used for the hybrid confidence range. Furthermore, when a weighted average is applied, the weighted average function (see FIG. 13) may be used for the hybrid confidence range and may include a lower limit of the hybrid confidence range based on lower limits of the amplitude confidence range and the attenuation confidence range. An upper limit of the hybrid confidence range may be calculated in a similar manner.

In this example, track #2 of FIG. 14A illustrates flags 68, 70, 72 to indicate which bond index log is used for the hybrid log, e.g. amplitude bond index (68), attenuation bond index (70), or weighted average of both (72). Track #3 of FIG. 14A indicates a flag for low confidence. This track shows a flag indicating the confidence of a bond index log and particularly a low confidence range flag which can be raised when the hybrid confidence range is wider than a certain criterion.

Figure 15A:
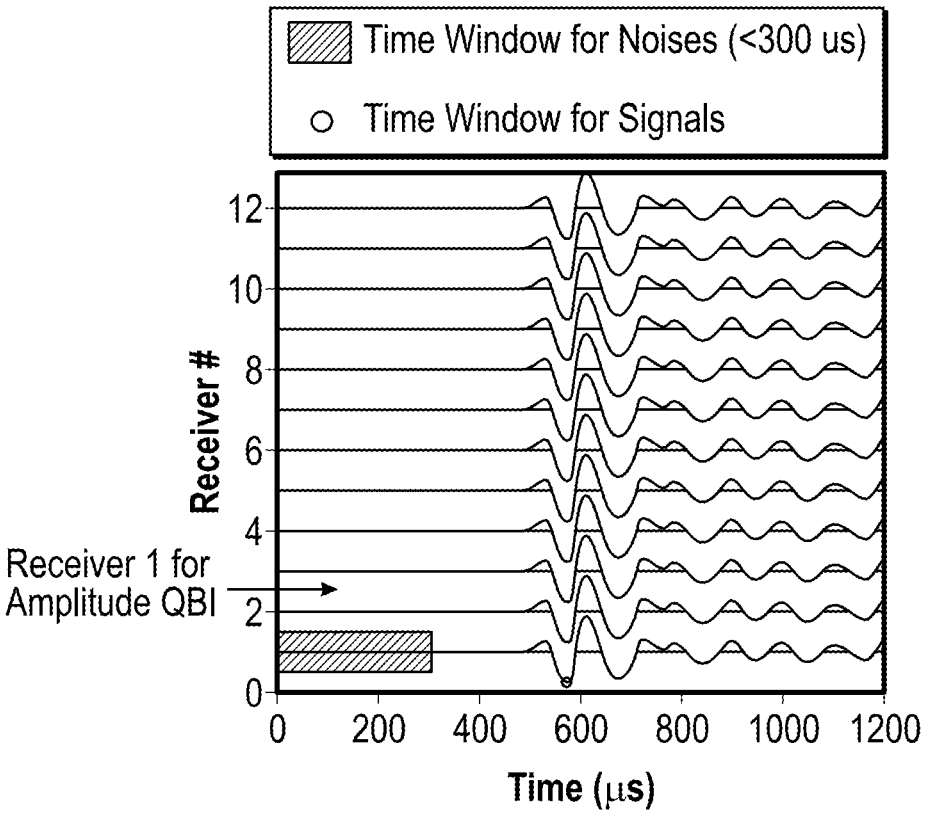
FIGS. 15A and 15B are graphical illustrations showing images representing calculation of a confidence range for an amplitude-based method, according to an embodiment of the disclosure.
Figure 15B:
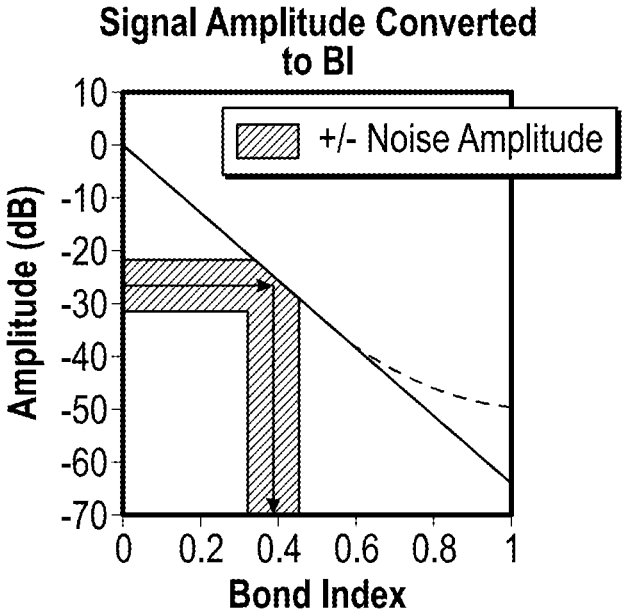

In FIG. 14A, track #4 represents a bond index log for amplitude and is shown by line 74. The confidence range for the amplitude bond index also is represented by FIGS. 15A and 15B which illustrates an example of logic which may be used to calculate the amplitude confidence range. According to the logic, a maximum amplitude of noise in an early time window may be determined at a receiver (e.g. up to 300 μs time window at a Receiver 1). In this example, no signal is expected to arrive in this early time window from the acoustic transmitter of an acoustic system even in a very fast formation and thus noise level can be evaluated appropriately. The noise value determined is then added/subtracted to the signal amplitude detected on the acoustic waveform in the time window to determine a signal amplitude with noise variance. Subsequently, amplitude-based bond indices are calculated for both signal amplitudes with the addition and subtraction of noise and this may be used as an amplitude confidence range. It should be noted the upper and lower bounds for weighted averaging are indicated at bond index range 76. These bounds are displayed in this amplitude bond index track because the amplitude-based bond index relative to the bounds may be used to determine splicing for the hybrid bond index.

Track #5 of FIG. 14A illustrates a bond index log for attenuation via solid line 78. The confidence range for attenuation bond index also is shown at region 80. The confidence range for attenuation bond index may be taken from a wider confidence range indicated in tracks #6 and #7 of FIG. 14A at each depth along the well.

Figure 16A:
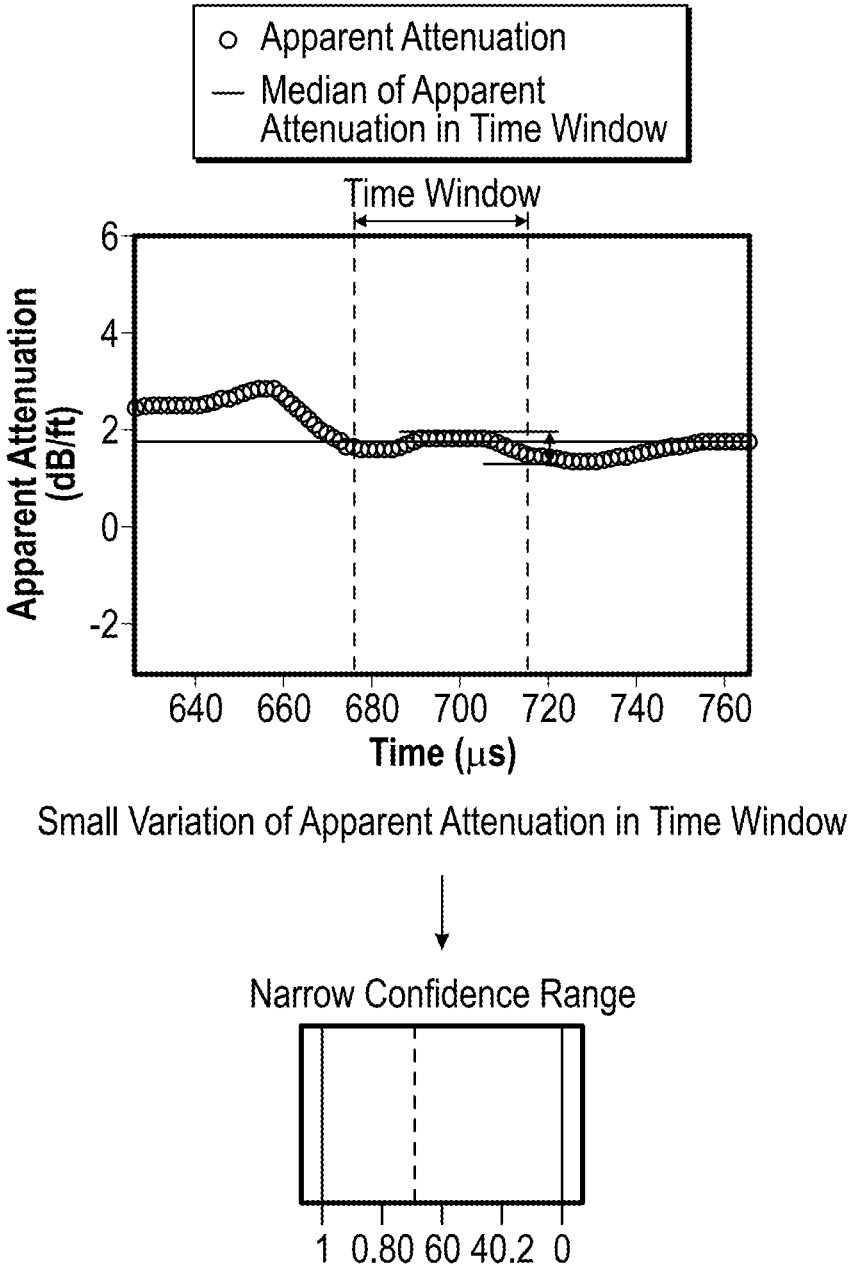
FIGS. 16A and 16B are graphical illustrations showing two plots and their corresponding confidence ranges in which the confidence range is based on variations of attenuations in a time window resulting in a narrow range (FIG. 16A) and resulting in a wide range (FIG. 16B), according to an embodiment of the disclosure.
Figure 16B:
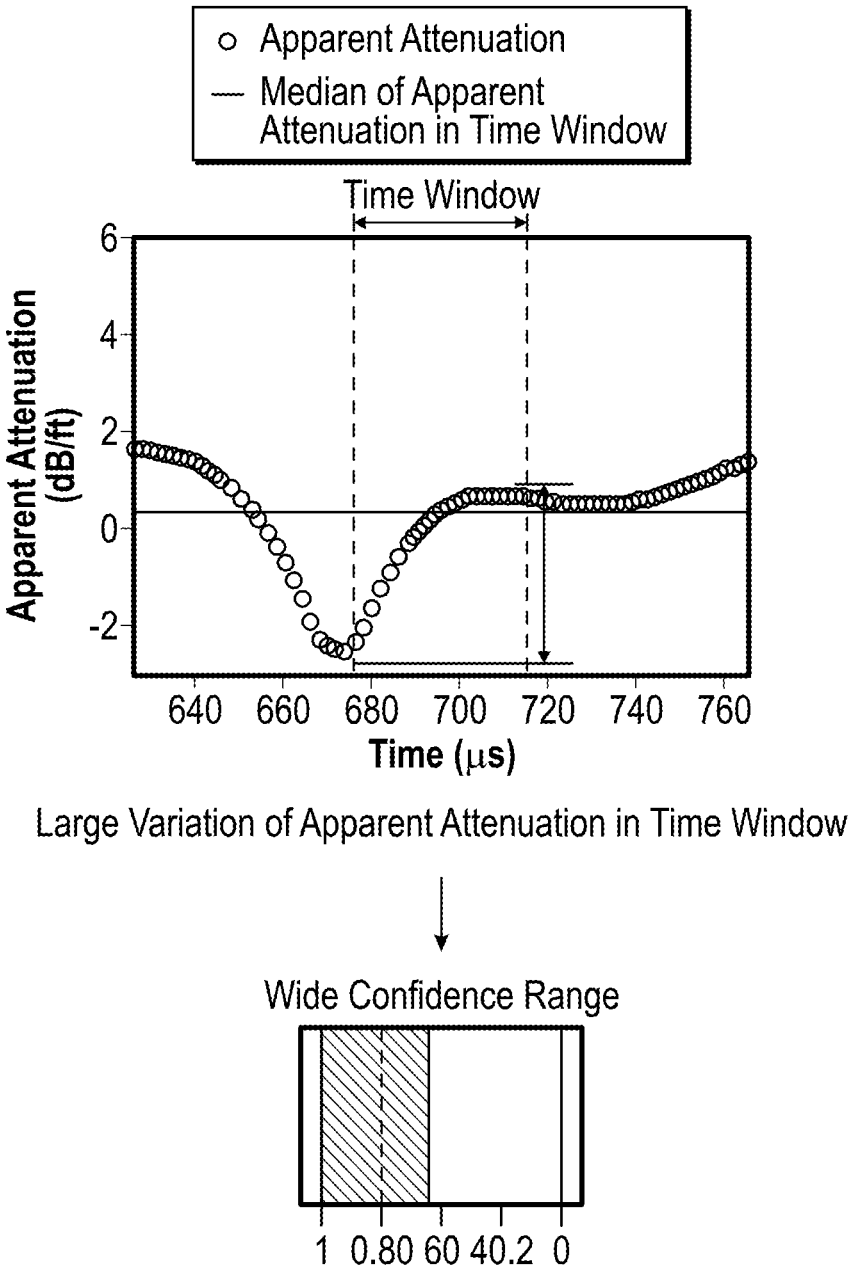

Track #6 of FIG. 14A illustrates an attenuation bond index log and its confidence range based on the variation of apparent attenuations within a selected time window. As previously described with reference to FIGS. 11A and 11B, apparent attenuation may be calculated at each time sample in the time window (e.g. 21 attenuations with a 40 μs time window width). When the variation of the attenuations becomes larger in the time window, the confidence range becomes wider and the reliability of the log is lower, as indicated graphically in FIGS. 16A and 16B.

Figure 17A:
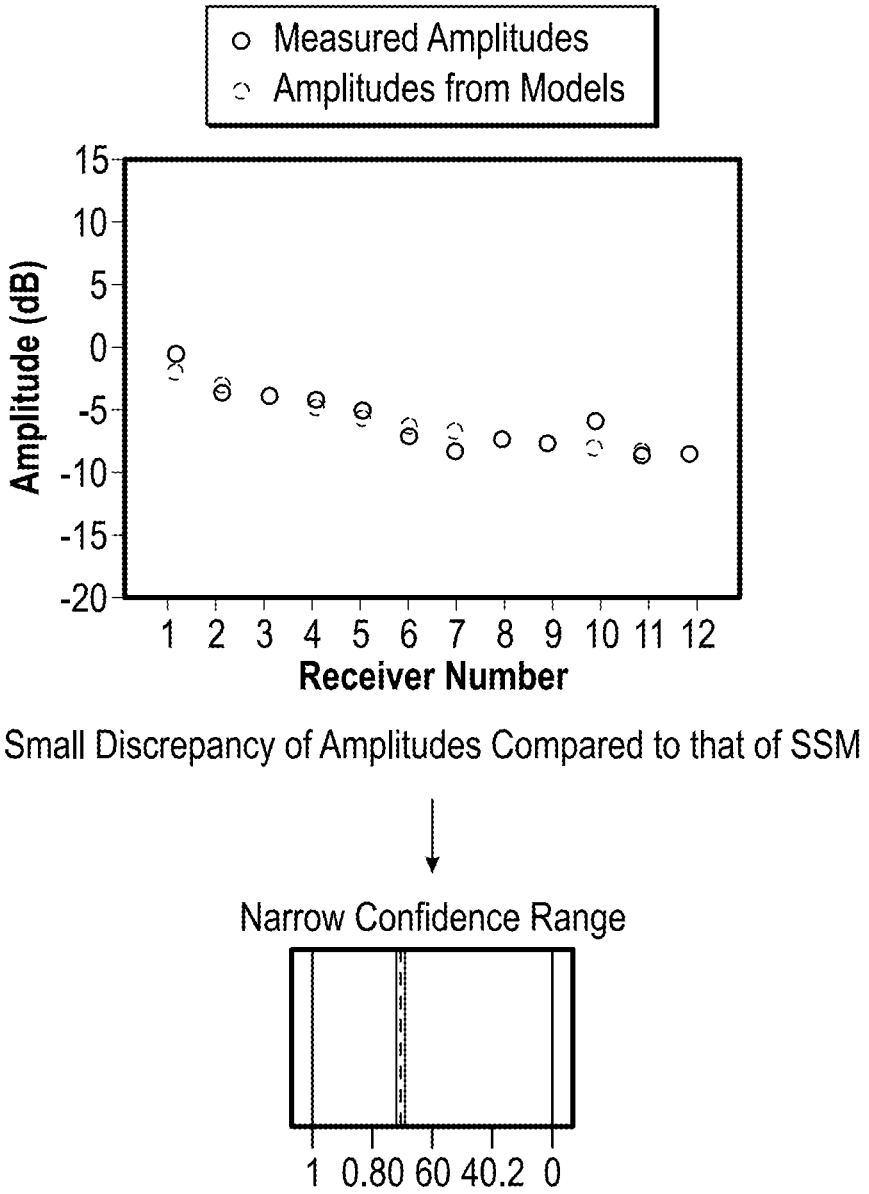
FIGS. 17A and 17B are graphical illustrations showing two plots and their corresponding confidence ranges in which the confidence ranges are based on amplitude matching with summation models that provide a narrow confidence range (FIG. 17A) and wide confidence range (FIG. 17B), according to an embodiment of the disclosure.
Figure 17B:
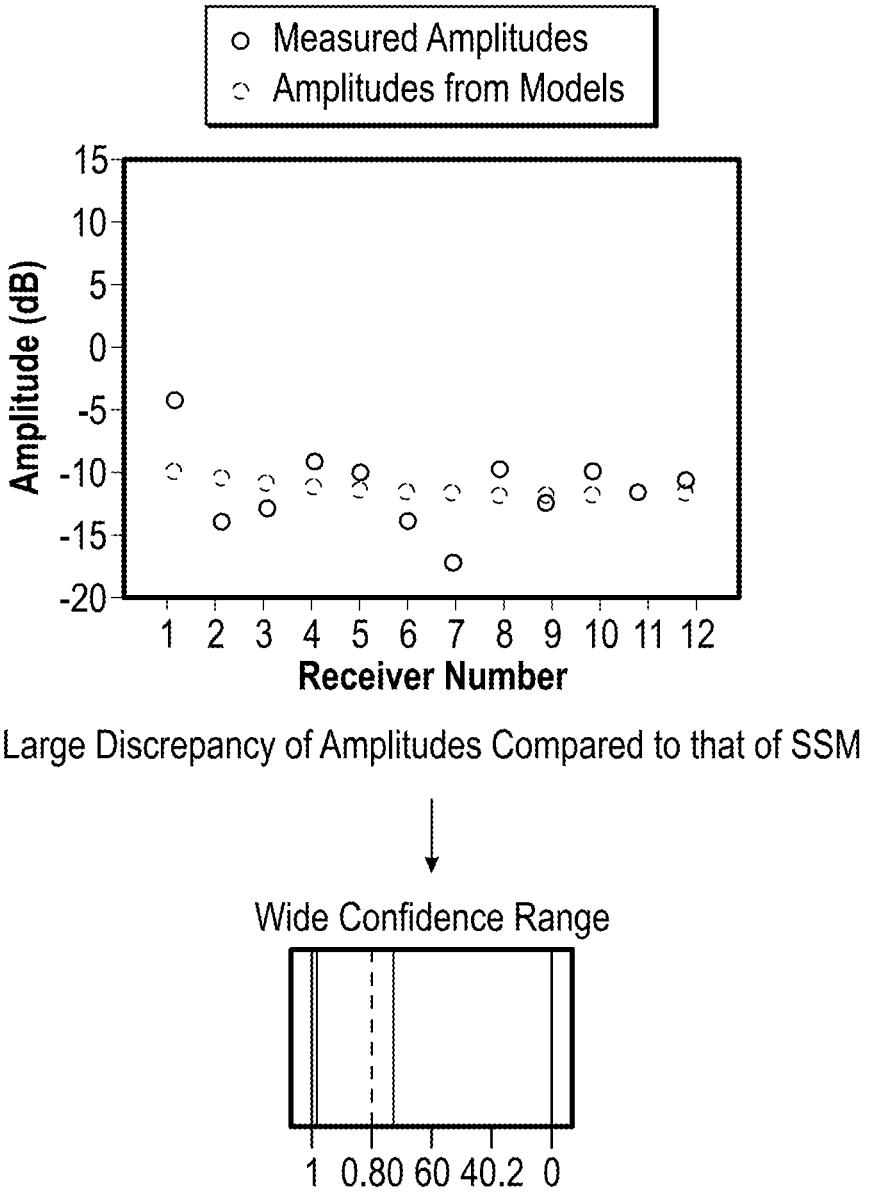

Track #7 of FIG. 14A illustrates an attenuation bond index log and its confidence range based on amplitude matching to summation model amplitudes. When the discrepancy of the measured amplitudes relative to the model amplitudes is larger, due to large noise for example, the confidence range becomes wider as indicated graphically in FIGS. 17A and 17B.

Figure 14B:
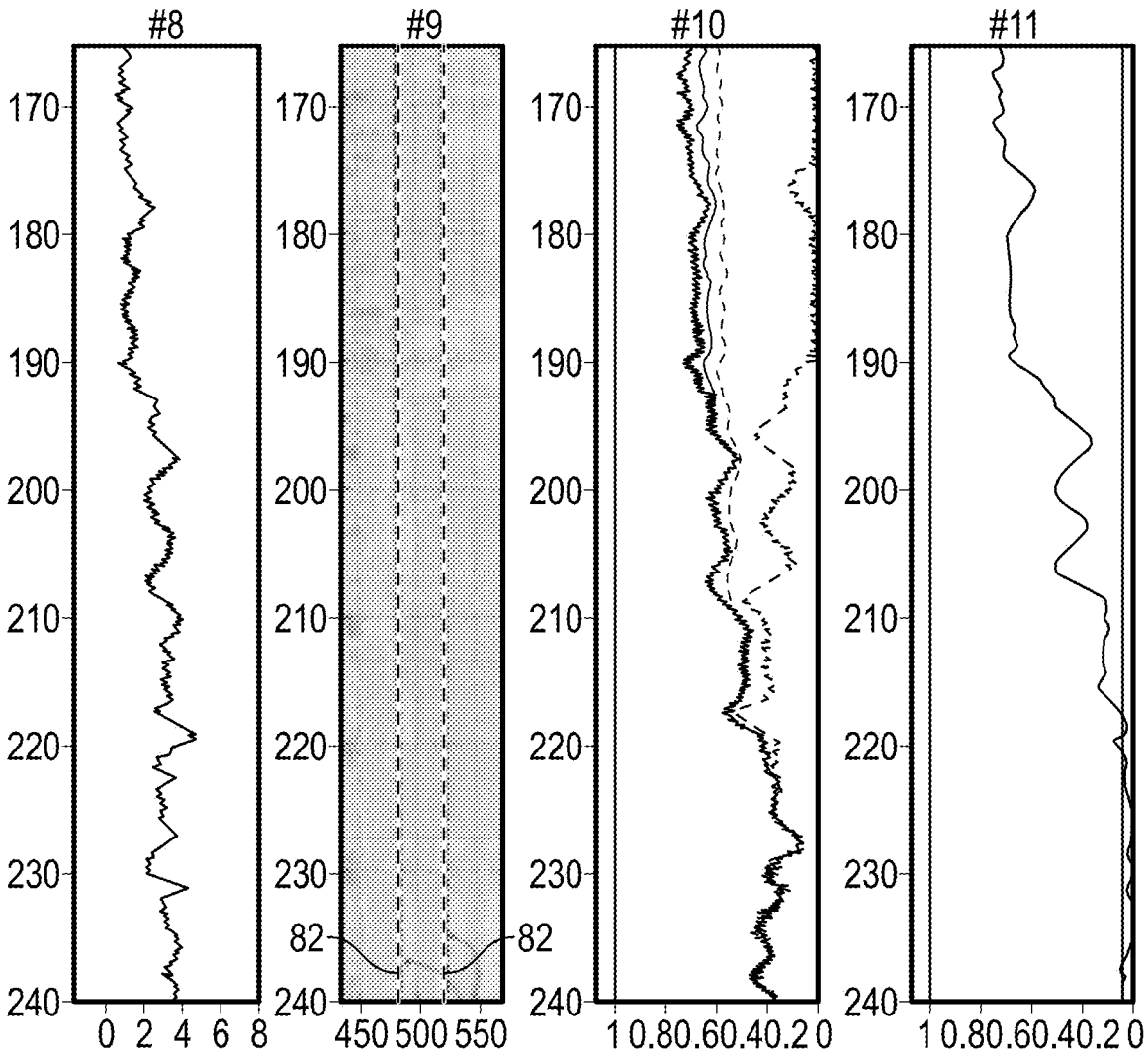

Track #8 of FIG. 14B illustrates an apparent attenuation log detected in a time window.

Figure 18A:
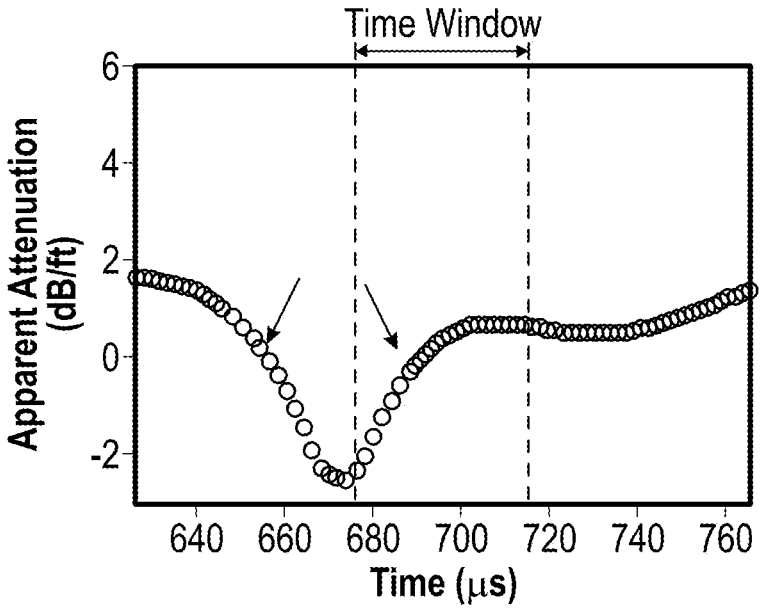
FIGS. 18A and 18B are graphical illustrations showing two corresponding plots providing an example of the time derivative of apparent attenuation, according to an embodiment of the disclosure.
Figure 18B:
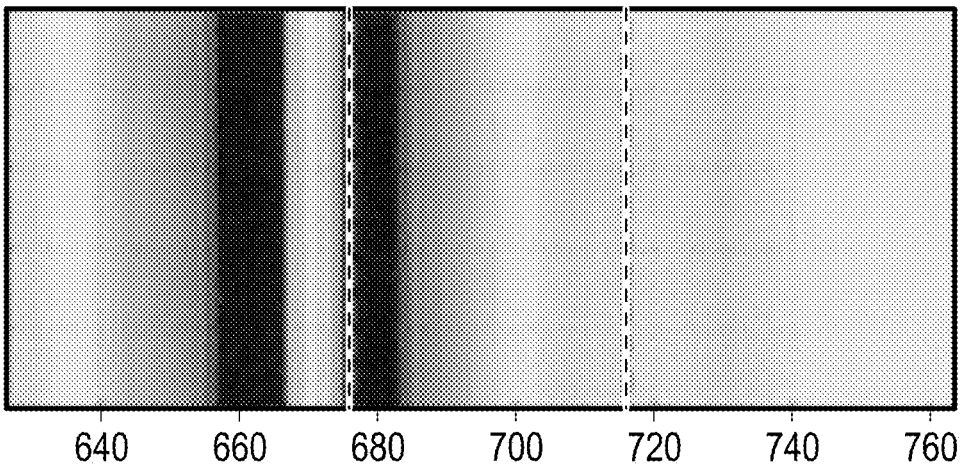

An image log is illustrated in track #9 of FIG. 14B and represents a time derivative of apparent attenuation. The dashed lines 82 indicate a time window position. This quality control range generally corresponds to the width of the confidence range in track #6 of FIG. 14A and may be used to verify the position of the selected time window. For example, a low gradient of attenuation indicates small variation of apparent attenuation and implies appropriate position of the time window. Processing of waveform data can be rerun with a proper time window setting based on this quality control result. FIGS. 18A and 18B illustrate one example frame of a large gradient of apparent attenuation in time and a corresponding time derivative image.

Figure 19A:
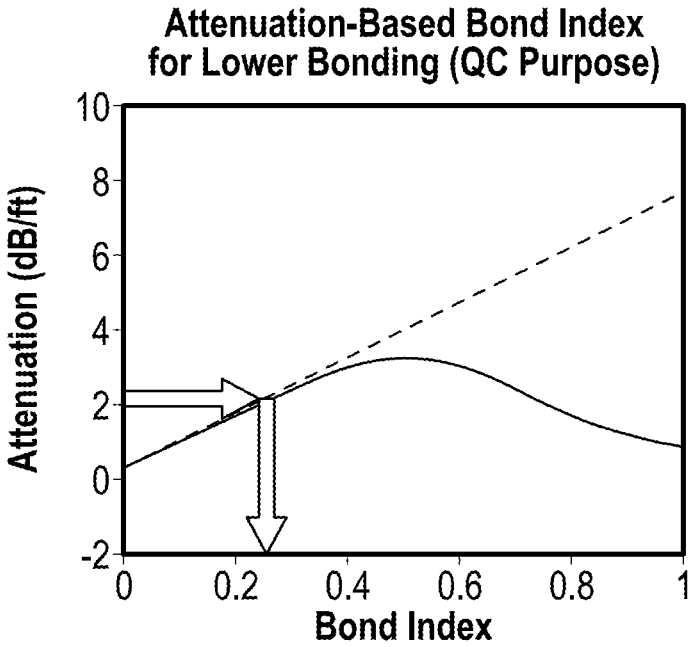
Figure 19B:
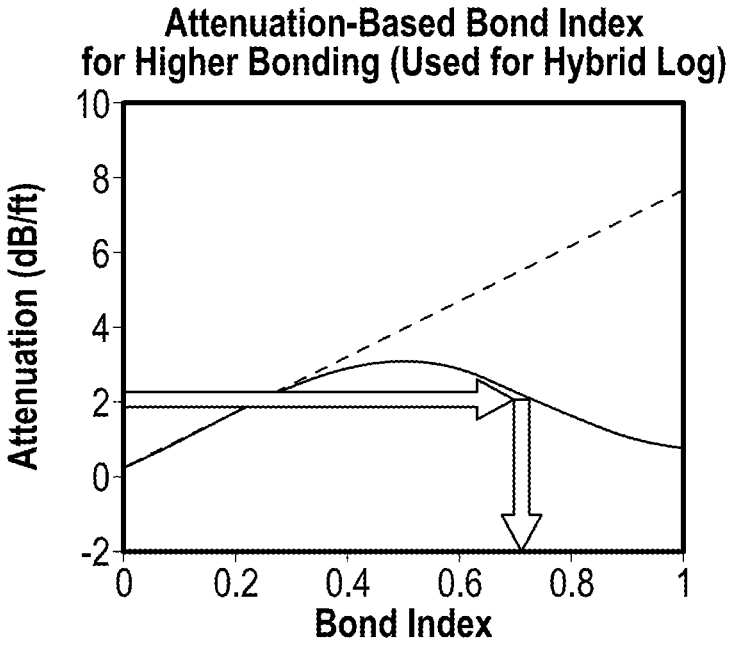
Figure 21A:
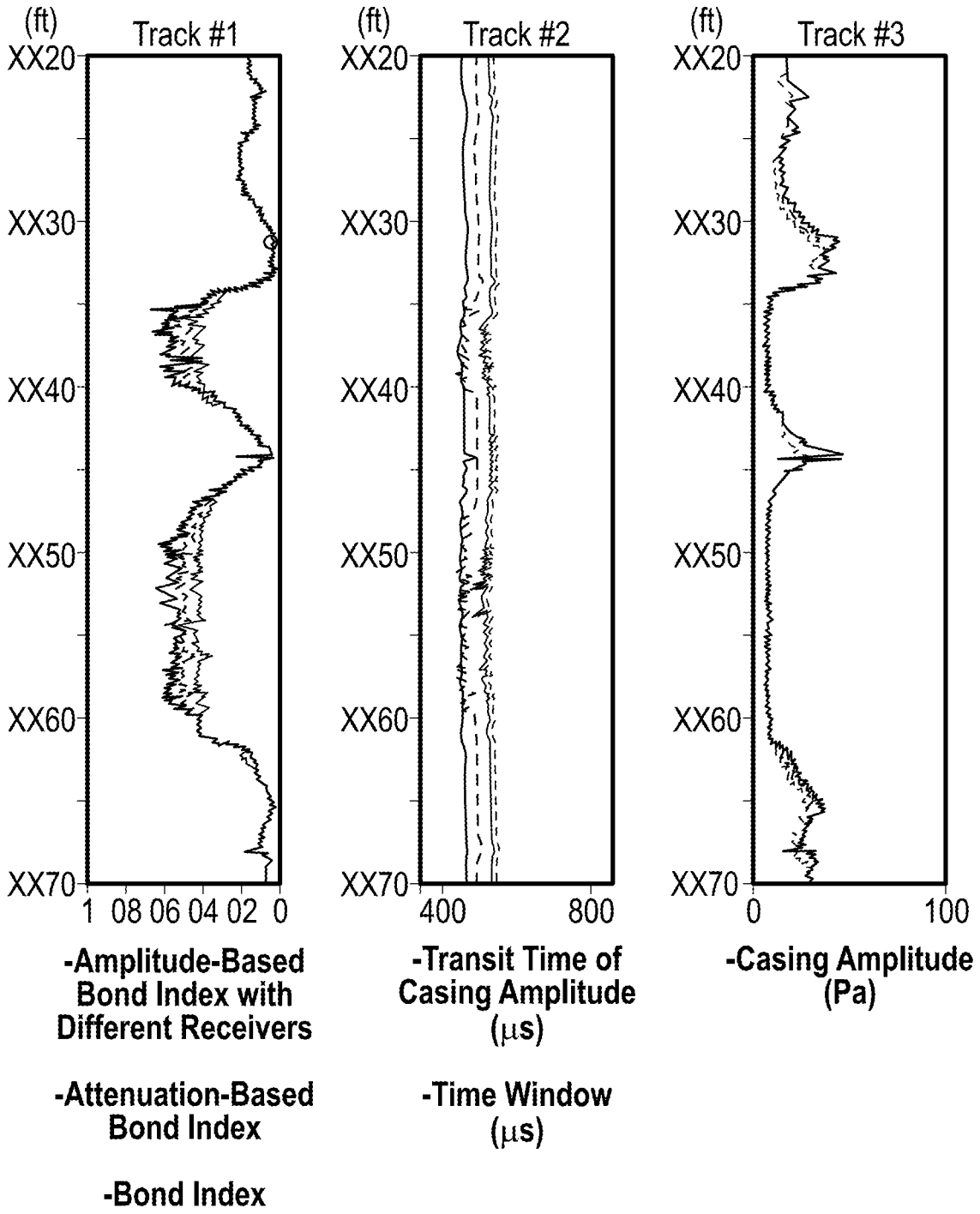
FIGS. 21A and 21B are graphical illustrations showing an example of a series of six quality control plots for an amplitude-based methodology, according to an embodiment of the disclosure.

In this example of quality control, track #10 of FIG. 14B is used to illustrate three types of logs in the form of an amplitude-based bond index from different receivers, an attenuation-based bond index for quality control with respect to lower bonding, and a bond index which corresponds to background noise level. The attenuation-based bond index in this track is calculated for lower bonding conditions using a linear relation with the bond index as shown graphically in FIG. 19A. It should be noted this attenuation-based bond index for lower bonding is different from the one used for the hybrid log in tracks #5, #6 and #7 of FIG. 14A. FIGS. 19A and 19B illustrate how these two bond indices may be calculated from apparent attenuation. Track #10 of FIG. 14B indicates a role similar to that played by the amplitude-based bond index in a quality control plot indicated by track #1 of FIG. 21A.

Referring to FIG. 14B, track #11 illustrates the difference between amplitude bond index (e.g. amplitude bond index based on data from Receiver 1) and an attenuation bond index for lower bonding shown in track #10 of FIG. 14B. This data can be useful for identifying the difference in bond index due to differences of applied method, e.g. amplitude-based method or attenuation-based method. For example, an amplitude-based approach is sensitive to both compressional and shear couplings between cement and casing while the attenuation-based approach is simply sensitive to shear coupling. Such difference in the sensitivity to compressional and shear coupling can cause a difference in the bond index between these two methods in at least some conditions, e.g. a condition in which a tiny micro-annulus gap is formed between the casing and cement.

Figure 14C:
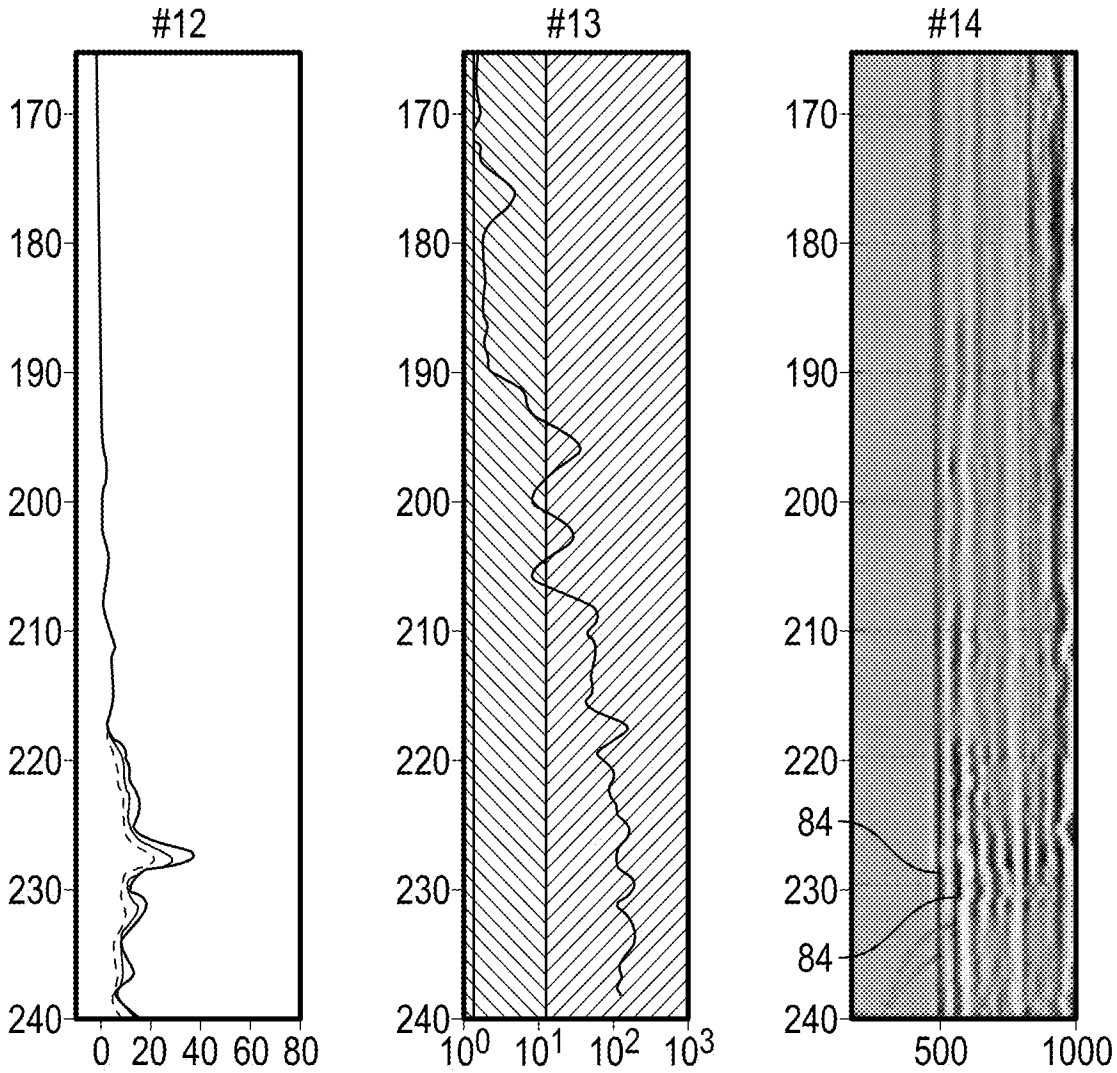

In FIG. 14C, track #12 illustrates detected amplitudes for the amplitude-based method at selected receivers and a given noise amplitude. This track represents a similar role as the amplitude-based bond index and corresponding quality control plot as indicated by track #3 in FIG. 21A.

Track #13 in FIG. 14C represents a synthetic amplitude of a casing arrival signal at zero T-R (transmitter-receiver) spacing which may be computed by considering measured amplitudes and attenuations. This track may be used to identify measurement limits of amplitude-based methods and can represent a similar role as that played by the amplitude-based bond index and corresponding quality control plot indicated by track #4 illustrated in FIG. 21B.

Figure 21B:
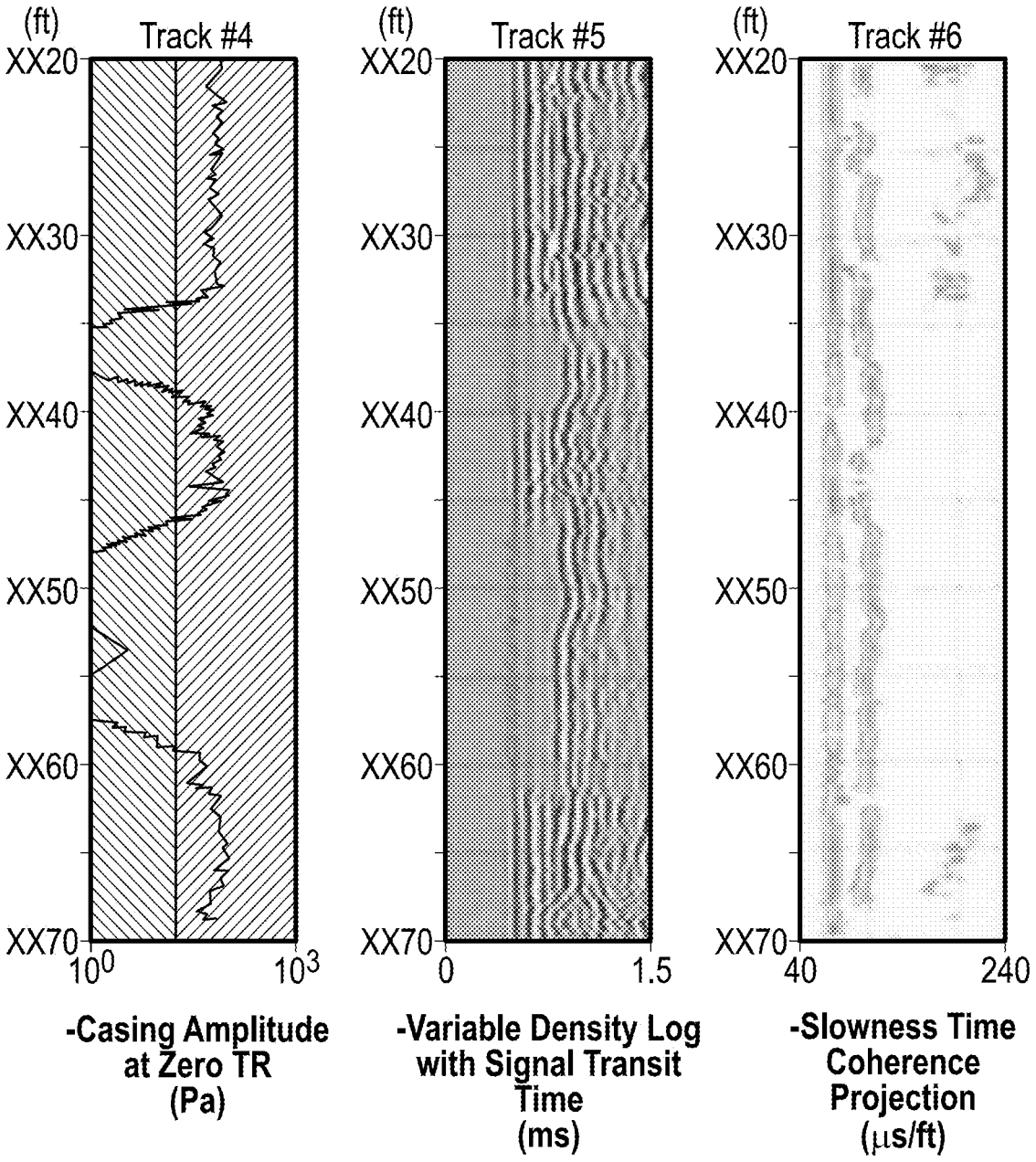

Additionally, track #14 in FIG. 14C represents a VDL (variable density log) and a time window position via corresponding vertical lines 84 and represents a role similar to that played by the amplitude-based bond index and its corresponding quality control plot indicated by track #5 of FIG. 21B.

Figure 20:
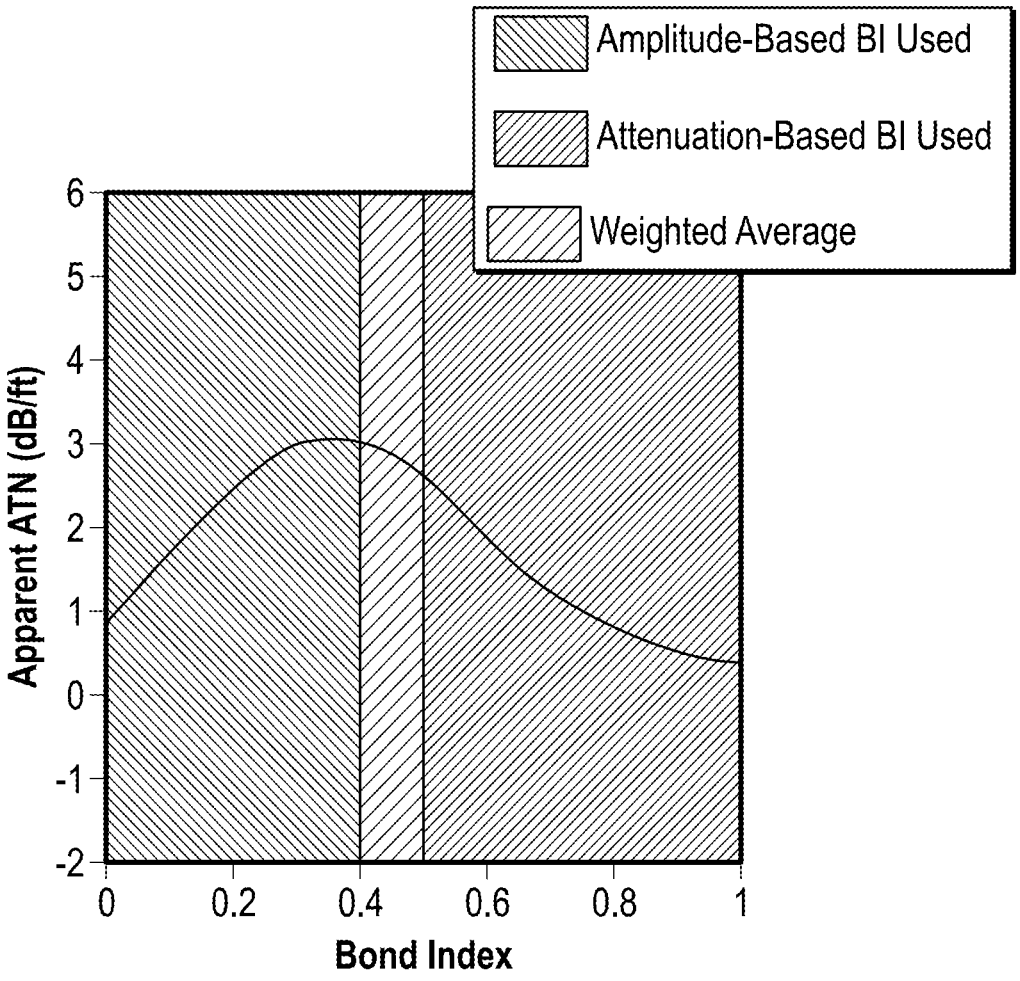
FIG. 20 is a graphical illustration of a plot showing apparent attenuation versus bond index based on a summation model, according to an embodiment of the disclosure.

It should be noted that FIG. 20 graphically illustrates a plot of apparent attenuation versus bond index based on the summation model. This plot can be useful in determining and understanding and applicable range of bond index for each method. The plot also may be useful in determining and understanding the degree of sensitivity in high bonding conditions between the cement and the casing.

Accordingly, the methodologies described herein provide techniques for quantitative cement bond evaluation. For example, the methodologies may include a processing workflow for amplitude-based, attenuation-based, and hybrid methodologies as described with reference to FIGS. 5-7 above. The methodologies also may include preprocessing data including using real raw waveforms, waveform envelopes, filter applications, and waveform stacking in depth, as described above (see, for example, description of waveforms and time windows with reference to FIG. 8). Embodiments also may include methods for calculation of amplitude, e.g. peak amplitude and an amplitude envelope as described above with reference to FIG. 10.

By way of further examples, the methodologies may include calculation of attenuation, e.g. linear fitting through receiver array data and combinations of receivers, as described above with reference to FIGS. 11A and 11B. The methodologies also may include time window setting, e.g. fixing a time window through multiple depths, providing an adjustable time window at each depth, and enabling time window selection based on the time derivative of apparent attenuation, as described above, for example, with reference to FIG. 9. The methodologies also may include model-based conversion of amplitude and attenuation into a bond index, as described with reference to FIGS. 1A and 1B.

The methodologies also may include splicing for two logs, e.g. switching between two logs or determining a weighted average based on two logs, as described above with reference to FIGS. 12 and 13. In some embodiments, the methodologies also provide for quality controls which may utilize confidence ranges of a bond index, e.g. amplitude confidence ranges, attenuation confidence ranges (based on matching amplitudes with a model and on variations of apparent attenuation in a time window), and combined hybrid confidence ranges based on amplitude and attenuation confidence ranges. Quality control methodology also may utilize time derivatives of apparent attenuation as well as differences between amplitude bond index and attenuation bond index for lower levels of bonding.

Furthermore, the methodologies described herein may be carried out, at least in part, on a variety of data processing systems. For example, computer-based systems may be employed to collect receiver data and to process that data according to methodologies described herein for cement bond evaluation. Such processing systems may be located on-site or remotely and may include various automatic data input devices and/or other data input devices. Processing results may be output to a suitable computer display or other output device. For example, the data may be processed and results may be output regarding various parameters related to the cement bond evaluation, including preparing and outputting quality control plots based on the processing results.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure.

What is claimed is:

1. A method for evaluating a cement bond, comprising:

collecting waveform data on acoustic waveforms obtained via one or more acoustic receivers, wherein the acoustic waveforms are affected by a cement bond formed with a well casing;

preprocessing the waveform data;

determining a time window for the preprocessed waveform data for a plurality of depths;

selecting one or more fixed times within the time window for each of the plurality of depths;

determining a waveform amplitude at each of the one or more fixed times within the time window for each of the plurality of depths, wherein the one or more fixed times within the time window for a first depth of the plurality of depths have same relative positions within the time window for the first depth as the one or more fixed times within the time window for a second depth of the plurality of depths;

deriving an amplitude-based bond index for a particular depth based at least in part on the waveform amplitude determined at a particular time of the one or more fixed times within the time window and conversion of the waveform amplitude determined at the particular time of the one or more fixed times using a linear model of casing arrival or a summation model of both casing and tool arrivals;

determining a waveform attenuation based at least in part on the preprocessed waveform data;

deriving an attenuation-based bond index based at least in part on the waveform attenuation;

combining the amplitude-based bond index and the attenuation-based bond index into a combined bond index over the plurality of depths, wherein combining the amplitude-based bond index and the attenuation-based bond index comprises using a splicing method utilizing a weighted average of the amplitude-based bond index and the attenuation-based bond index, and wherein the splicing method comprises utilizing the amplitude-based bond index below a first bond index threshold, the attenuation-based bond index above a second bond index threshold, and the weighted average of the amplitude-based bond index and the attenuation-based bond index between the first bond index threshold and the second bond index threshold, wherein the first bond index threshold is less than the second bond index threshold; and preparing and outputting a quality control plot based at least in part on the preprocessed waveform data.

2. The method as recited in claim 1, wherein the one or more acoustic receivers are coupled to a logging-while-drilling (LWD) tool system.

3. The method as recited in claim 1, wherein preprocessing comprises at least one of calculating a waveform envelope, filtering the waveform data, stacking waveform in depth, or using a real raw waveform as it is.

4. The method as recited in claim 1, wherein determining the time window comprises determining a fixed time window through multiple depths.

5. The method as recited in claim 1, wherein determining the time window comprises determining an adjustable time window at each depth of the plurality of depths.

6. The method as recited in claim 1, wherein preparing and outputting the quality control plot comprises determining a confidence range.

7. The method of claim 1, wherein the one or more fixed times comprises a time at the middle of the time window.

8. A method for evaluating a cement bond, comprising:

collecting waveform data on acoustic waveforms obtained via one or more acoustic receivers at a plurality of depths, wherein the acoustic waveforms are affected by a cement bond formed with a well casing at one or more depths;

preprocessing the waveform data;

determining a time window for the preprocessed waveform data at each of the plurality of depths;

selecting one or more fixed times within the time window at each of the plurality of depths, wherein the one or more fixed times have consistent relative positions within the time window at each depth of the plurality of depths;

determining waveform attenuation based at least in part on amplitudes of the preprocessed waveform data that are determined at the one or more fixed times within the time window of each of the plurality of depths;

deriving an attenuation based bond index, for each of the one or more depths, based at least in part on the waveform attenuation, calculated at the one or more fixed times within the time window, and conversion of the waveform attenuation using a linear model of casing arrival or a summation model of both casing and tool arrivals, wherein the one or more fixed times comprises a plurality of fixed times, and wherein determining the waveform attenuation comprises calculating a median waveform attenuation of a plurality of waveform attenuations, wherein each of the plurality of waveform attenuations are calculated at different fixed times of the plurality of fixed times within the time window at each depth of the one or more depths; and preparing and outputting a quality control plot based at least in part on the preprocessed waveform data.

9. The method as recited in claim 8, wherein determining the time window comprises fixing the time window through each of the plurality of depths.

10. The method as recited in claim 8, wherein determining the time window comprises determining an adjustable time window at each of the plurality of depths.

11. The method as recited in claim 8, wherein determining the waveform attenuation comprises linear fitting of the amplitudes obtained from the one or more acoustic receivers.

12. The method as recited in claim 8, wherein preparing and outputting the quality control plot comprises determining a confidence range based at least in part on matching the amplitudes with a model or variations of apparent attenuation in the time window.

13. The method of claim 8, wherein the one or more fixed times comprise a plurality of fixed times, wherein the plurality of fixed times are evenly spaced within the time window.

14. The method of claim 8, wherein the one or more acoustic receivers comprises a receiver array comprising a receiver at each of the plurality of depths.

15. A method for evaluating a cement bond, comprising:

collecting waveform data on acoustic waveforms obtained via a plurality of acoustic receivers, wherein the acoustic waveforms are affected by a cement bond formed with a well casing;

determining a time window for the waveform data for each of a plurality of depths;

selecting one or more fixed times within the time window for each of the plurality of depths, wherein the one or more fixed times within the time window at a first depth of the plurality of depths have same relative positions within the time window at the first depth as the one or more fixed times within the time window at a second depth of the plurality of depths;

calculating waveform amplitude and waveform attenuation from the waveform data for the plurality of depths, wherein the waveform amplitude for each of the plurality of depths is calculated at the one or more fixed times within the time window for each of the plurality of depths;

deriving an amplitude-based bond index and an attenuation-based bond index at each of the plurality of depths based at least in part on the calculation of the waveform amplitude at the one or more fixed times within the time window for each of the plurality of depths and the waveform attenuation, respectively;

combining the amplitude-based bond index and the attenuation-based bond index into a combined bond index over the plurality of depths, wherein combining the amplitude-based bond index and the attenuation-based bond index comprises using a splicing method utilizing a weighted average of the amplitude-based bond index and the attenuation-based bond index, and wherein the splicing method comprises utilizing the amplitude-based bond index below a first bond index threshold, the attenuation-based bond index above a second bond index threshold, and the weighted average of the amplitude-based bond index and the attenuation-based bond index between the first bond index threshold and the second bond index threshold, wherein the first bond index threshold is less than the second bond index threshold; and preparing and outputting the combined bond index corresponding to each of the plurality of depths.

16. The method as recited in claim 15, wherein combining the amplitude-based bond index and the attenuation-based bond index comprises using the splicing method including a switch between the amplitude-based bond index and the attenuation-based bond index.

17. The method as recited in claim 15, comprising preparing and outputting a quality control plot comprising a difference between the amplitude-based bond index and the attenuation-based bond index for areas of lower level cement bonding.

18. The method of claim 15, wherein the one or more fixed times comprises a plurality of fixed times, and wherein determining the waveform attenuation comprises calculating a median waveform attenuation of a plurality of waveform attenuations, wherein each of the plurality of waveform attenuations are calculated at different fixed times of the plurality of fixed times within the time window at each depth of the one or more depths.

* * * * *